US006898258B2

(12) United States Patent
Ohsono et al.

(10) Patent No.: US 6,898,258 B2
(45) Date of Patent: May 24, 2005

(54) CASK

(75) Inventors: Katsunari Ohsono, Hyogo (JP); Toshihiro Matsuoka, Hyogo (JP); Shinji Ookame, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 104 days.

(21) Appl. No.: 10/080,709

(22) Filed: Feb. 25, 2002

(65) Prior Publication Data

US 2002/0118786 A1 Aug. 29, 2002

(30) Foreign Application Priority Data

Feb. 26, 2001 (JP) ..... 2001-051161

(51) Int. Cl.[7] ..... G21C 19/00

(52) U.S. Cl. ..... 376/272; 250/505.1; 250/506.1; 250/507.1; 250/508.1

(58) Field of Search ..... 376/272, 327–339; 250/505.1, 506.1–507.1, 518.1

(56) References Cited

U.S. PATENT DOCUMENTS

| | | | | | |
|---|---|---|---|---|---|
| 3,036,964 | A | * | 5/1962 | Horning | 376/219 |
| 4,004,972 | A | * | 1/1977 | Mogard | 376/420 |
| 4,292,528 | A | * | 9/1981 | Shaffer et al. | 250/506.1 |
| 4,399,366 | A | * | 8/1983 | Bucholz | 250/507.1 |
| 4,634,875 | A | * | 1/1987 | Kugeler et al. | 250/506.1 |
| 4,666,659 | A | * | 5/1987 | Lusk et al. | 250/507.1 |
| 4,711,758 | A | * | 12/1987 | Machado et al. | 376/272 |
| 4,800,283 | A | * | 1/1989 | Efferding | 250/506.1 |
| 4,827,139 | A | * | 5/1989 | Wells et al. | 250/506.1 |
| 4,862,007 | A | * | 8/1989 | Mallory | 250/506.1 |
| 4,997,618 | A | * | 3/1991 | Efferding | 376/272 |
| 5,063,299 | A | | 11/1991 | Efferding | |
| 5,641,970 | A | * | 6/1997 | Taniuchi et al. | 250/506.1 |
| 5,651,038 | A | | 7/1997 | Chechelnitsky et al. | |
| 5,887,042 | A | * | 3/1999 | Akamatsu et al. | 250/506.1 |
| 6,064,710 | A | * | 5/2000 | Singh | 250/506.1 |
| 6,327,321 | B1 | * | 12/2001 | Holman | 376/260 |

FOREIGN PATENT DOCUMENTS

| | | |
|---|---|---|
| DE | 2835392 C2 * | 8/1978 |
| DE | 2835392 C2 * | 2/1980 |
| DE | 100 45 995 | 6/2001 |
| EP | 0 158 849 | 10/1985 |
| EP | 0 343 410 | 11/1989 |
| EP | 1 128 392 | 8/2001 |
| JP | 61-118097 | 7/1986 |
| JP | 61-140999 | 9/1986 |
| JP | 62-242725 | 11/1987 |
| JP | HEI4-357498 | 12/1992 |
| JP | 09-159796 | 6/1997 |
| JP | 2954151 | 10/1999 |
| JP | 11-287894 | 10/1999 |
| JP | 2001-201595 | 7/2001 |
| WO | WO 95/26029 | 9/1995 |
| WO | WO 01/18823 | 3/2001 |

OTHER PUBLICATIONS

Webster's New International Dictionary of the English Language, Merriam Co., Second Edition, p. 546.*

K. Maruoka, Nuclear Viewpoints, vol. 44, No. 4, pp. 38–39, "Spent–Fuel Storage Container by Mitsubishi Heavy Industries, Ltd.", Apr. 1, 1998 (with partial English translation).

* cited by examiner

*Primary Examiner*—Michael J. Carone
*Assistant Examiner*—R Palabrica
(74) *Attorney, Agent, or Firm*—Oblon, Spivak, McClelland, Maier & Neustadt, P.C.

(57) ABSTRACT

In the cask, a shape within a cavity of a barrel main body is formed in a shape corresponding to an outer shape of a basket. The basket has a structure obtained by alternately piling up plate-like members vertically. A heat conducting plate is provided on an outer periphery of the plate-like member. Accordingly, since the basket and the cavity are in a state of being in contact state in a wide area, an efficiency of heat conduction is improved.

7 Claims, 23 Drawing Sheets

CASK

FIELD OF THE INVENTION

The present invention relates to a cask for receiving and stocking a spent fuel assembly, having improved thermal conduction efficiency and increased capacity to store the spent fuel assembly, and which is compact and light.

BACKGROUND OF THE INVENTION

A nuclear fuel assembly which finishes combustion in a terminal phase of a nuclear fuel cycle and can not be used is called as a spent nuclear fuel. Since the spent nuclear fuel contains a radioactive material such as an FP (fission product) or the like, it is necessary to thermally cool, so that the spent nuclear fuel is cooled by a cooling pit in a nuclear power plant for a predetermined period (one to three years). Thereafter, the spent nuclear fuel is received in a cask corresponding to a shielded vessel, and transported to a reprocessing facility by a truck or the like so as to be stocked. When the spent fuel assembly is received within the cask, a holding element having a grid-like cross section called as a basket is used. The spent fuel assemblies are inserted in a plurality of cells corresponding to receiving spaces formed in the basket one by one, whereby it is possible to secure a proper holding force against a vibration during the transportation or the like.

As a conventional example of the cask mentioned above, various kinds of structures are disclosed in "Nuclear Power eye" (issued in Apr. 1, 1998 by DAILY INDUSTRIAL PUBLICATION PRODUCTION), Japanese Patent Application Laid-Open No. 62-242725 and the like. A description will be given below of a cask corresponding to a base which develops the present invention. In this case, the following contents will be shown for a convenience of description, and does not mean so-called known and used techniques.

FIG. 24 is a perspective view which shows one example of a cask. FIG. 25 is a cross sectional view in an axial direction of the cask shown in FIG. 24. A cask 500 is constituted by a cylindrical barrel main body 501, a resin 502 corresponding to a neutron shield provided in an outer periphery of the barrel main body 501, an external cylinder 503, a bottom section 504 and a cover section 505. The barrel main body 501 and the bottom section 504 are formed by a forged product made of a carbon steel corresponding to a γ ray shield. Further, the cover section 505 is constituted by a primary cover 506 and a secondary cover 507 which are made of a stainless steel or the like. The barrel main body 501 and the bottom section 504 are connected according to a butt welding. The primary cover 506 and the secondary cover 507 are fixed to the barrel main body 501 by a bolt made of a stainless steel or the like. A metal O-ring is interposed between the cover section 505 and the barrel main body 501, whereby an air tightness in an inner section is kept.

A plurality of inner fins 508 executing a thermal conduction are provided between the barrel main body 501 and the external cylinder 503. The inner fins 508 employ a copper material which increases a thermal conduction efficiency. The resin 502 is poured into a space formed by the inner fins 508 in a flowing state and is solidified due to a cooling operation. A basket 509 is structured such that sixty nine square pipes 510 are collected in a bundle shape as shown in FIG. 24, and is inserted within a cavity 511 of the barrel main body 501 in a substantially bound state.

The square pipes 510 are made of an aluminum alloy in which a neutron absorber (boron: B) is mixed so as to prevent the inserted spent fuel assemblies from reaching a critical state. In this case, trunnions 513 which suspend the cask 500 are provided in both sides of the cask main body 512 (one is omitted). Further, a buffer 514 in which a wood material or the like is assembled in an inner section so as to constitute the buffer material are mounted to both end sections of the cask main body 512 (one is omitted).

In this case, the basket 509 may employ a structure formed in a box-of-cake shape, or an integrally cast structure in addition to the structure in which the square pipes 510 are collected in the bundle shape. The box-of-cake shaped basket is constructed by forming notches in both sides of a rectangular plate basket material and vertically crossing the basket materials by the notches so as to be alternately assembled. Accordingly, it is possible to form the basket having a plurality of cells. Further, the basket having the integrally cast structure is constructed by forming a whole of the basket according to a casting, and cells thereof are molded by using a core or according to a machining.

In the instance of actually manufacturing the cask 500 mentioned above, it is normally necessary to consider design conditions such as a receiving number, a size, a weight and the like of the spent fuel assemblies. In particular, it is preferable to employ a cask in which a receiving number is large, an outer diameter is small and a weight is small. However, according to the structure of the cask 500 mentioned above, since the square pipe 510 in an outermost periphery is in line contact with the inner surface of the cavity 511 (this matter is applied to both of the box-of-cake shaped basket and the basket having the integrally cast structure in the same manner), a space S is generated between the basket 509 and the cavity 511, and a heat conduction from the cell 515 to the barrel main body 501 cannot be efficiently executed. Further, since the diameter of the barrel main body 501 is increased due to an existence of the space S, the cask 500 becomes heavy.

On the contrary, since an amount of radiation leaking out of the cask is restricted by a total amount of the neutrons and the γ rays, it is sufficient to reduce a thickness of the barrel main body 501 in order to lighten the cask 500. However, since it is necessary to constitute the γ rays shield, a thickness which secures a γ ray shielding function is required in a side of the barrel main body 501. Further, the cask 500 mentioned above is structured such as to be capable of receiving sixty nine fuel assemblies which have never been achieved by the conventional art, however, when the diameter of the barrel main body 501 is reduced in the structure for the purpose of achieving a predetermined weight, the receiving number of the spent fuel assemblies is reduced.

SUMMARY OF THE INVENTION

It is an object of this invention to provide a cask which satisfies any one of conditions such as improving a heat conduction efficiency, increasing a receiving number of spent fuel assemblies and making compact or light.

The cask according to one aspect of this invention comprises a basket having square shaped cross section, wherein cutting sections are provided in both edges of rectangular plate-like members having a neutron absorbing performance and the plate-like members are alternately piled up vertically in such a manner as to mutually insert the cutting sections to each other, a barrel main body which shields γ rays and forms an inner side of a cavity in a shape aligning with the basket, and a neutron shielding body arranged in an outer periphery of the barrel main body. A spent fuel assembly is stored in each of cells of the basket inserted in the cavity.

The spent fuel assembly generates a decay heat as well as generating a radiation. The spent fuel assembly is received within the cell of the basket, however, since the inner side of the cavity of the barrel main body is formed in the shape aligning with the outer shape of the basket, the plate-like member (in particular, the square cross sectional shaped portion) in the outer side becomes in a state of being in contact with the inner surface of the cavity, when the basket is inserted within the cavity. Further, since the shape within the cavity is aligned with the outer shape of the basket, a space between the basket and the cavity does not exist or is made very small. Accordingly, the decay heat is effectively conducted from the basket to the barrel main body via a helium gas introduced into the inner section or directly via the contact portion.

Further, since the space within the cavity is made very little or it is not there at all, it is possible to make an outer diameter of the barrel main body small. On the contrary, when the outer diameter of the barrel main body is made in the same manner of the barrel main body as shown in FIG. 25, it is possible to form more cells. In this case, in the contact state mentioned above, it is not necessary that the inner surface of the cavity and the outer surface of the basket are completely and always in contact with each other, and the contact state includes an instance in which a slight gap exists or the inner surface of the cavity and the outer surface of the basket are temporarily detached. Further, the plate-like member mentioned above includes a hollow structure shown in a third embodiment.

Further, since the plate-like member has the neutron absorbing function, it does not reach a critical state even when the spent fuel case is received. Further, the γ rays generated from the spent fuel assembly is shielded by the barrel main body, and the neutron is shielded by the neutron shielding body.

The cask according to another aspect of this invention comprises a basket having square shaped cross section, wherein a plurality of cells having a neutron absorbing performance and storing spent fuel assemblies are integrally cast, a barrel main body which shields γ rays and forms an inner side of a cavity in a shape aligning with the basket, and a neutron shielding body arranged in an outer periphery of the barrel main body. A spent fuel assembly is stored in each of cells of the basket inserted in the cavity.

Since the basket is integrally cast, and the inner shape of the cavity in the barrel main body is aligned with the outer shape of the basket having the square cross sectional shape, the outer surface of the basket becomes in the state of being in contact with the inner surface of the cavity in the same manner as mentioned above. Further, since the shape within the cavity is aligned with the outer shape of the basket, a space between the basket and the cavity does not exist or is made very small. Accordingly, the decay heat is effectively conducted from the basket to the barrel main body via a helium gas introduced into the inner section or directly via the contact portion. Further, it is possible to reduce the outer diameter of the barrel main body. On the contrary, when the outer diameter of the barrel main body is made in the same manner that of the barrel main body as shown in FIG. 25, it is possible to form more cells.

In the cask according to still another aspect of this invention, an inner side of a cavity in a barrel main body having a neutron shielding body in an outer periphery and shielding γ rays is formed in a shape corresponding to an outer shape of a basket having a square cross sectional shape constituted by a plurality of square pipes having a neutron absorbing performance in a state of inserting the square pipes within the cavity, a hollow dummy pipe having both ends closed is provided, a portion having a surplus thickness of the barrel main body within the cavity is formed in a shape corresponding to the dummy pipe, the dummy pipe is inserted within the cavity together with the basket in a state of being in contact with the square pipe, and a spent fuel assembly is received and stored within each of cells of the basket inserted within the cavity.

Other objects and features of this invention will become apparent from the following description with reference to the accompanying drawings.

DETAILED DESCRIPTIONS

Embodiments of the cask according to the present invention will be explained below with reference to the accompanying drawings. However, this invention is not limited by these embodiments. Further, it goes without saying that the structures which enable to be easily derived by those skilled in the art are included in the constituting elements of the invention.

Figure 1:
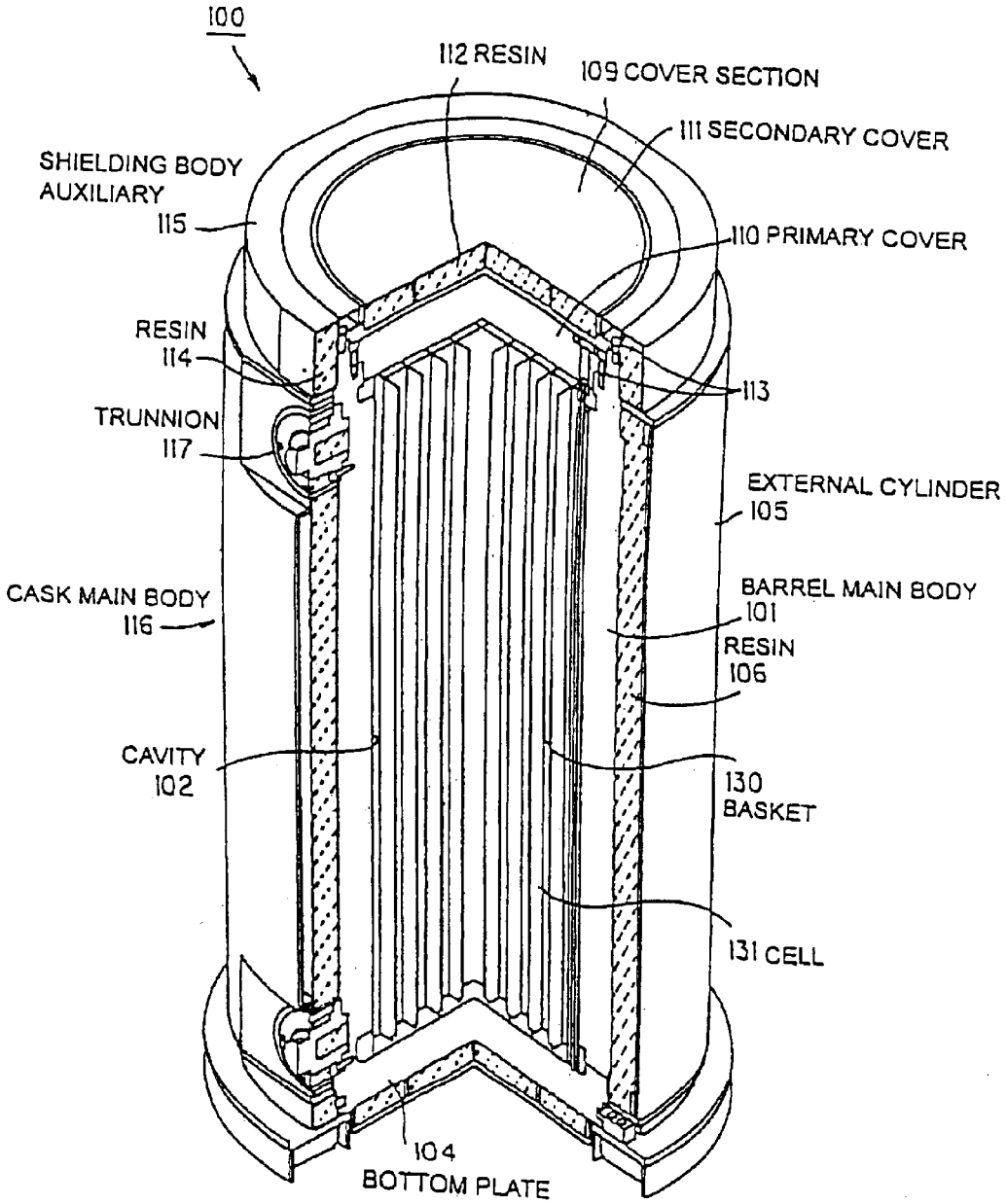
FIG. 1 is a perspective view which shows a cask according to a first embodiment of the present invention.
Figure 2:
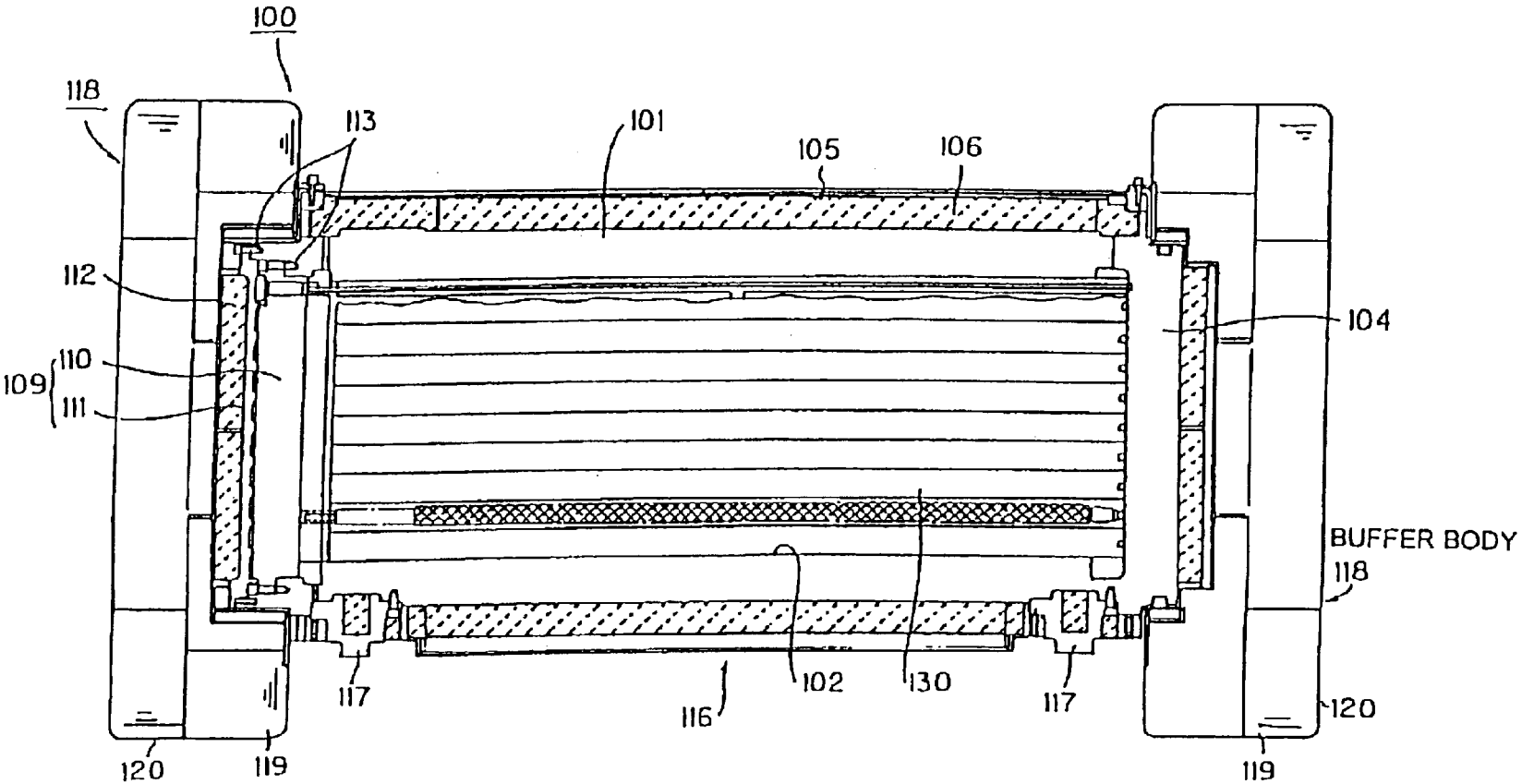
FIG. 2 is a cross sectional view in an axial direction showing the cask shown in FIG. 1.
Figure 3:
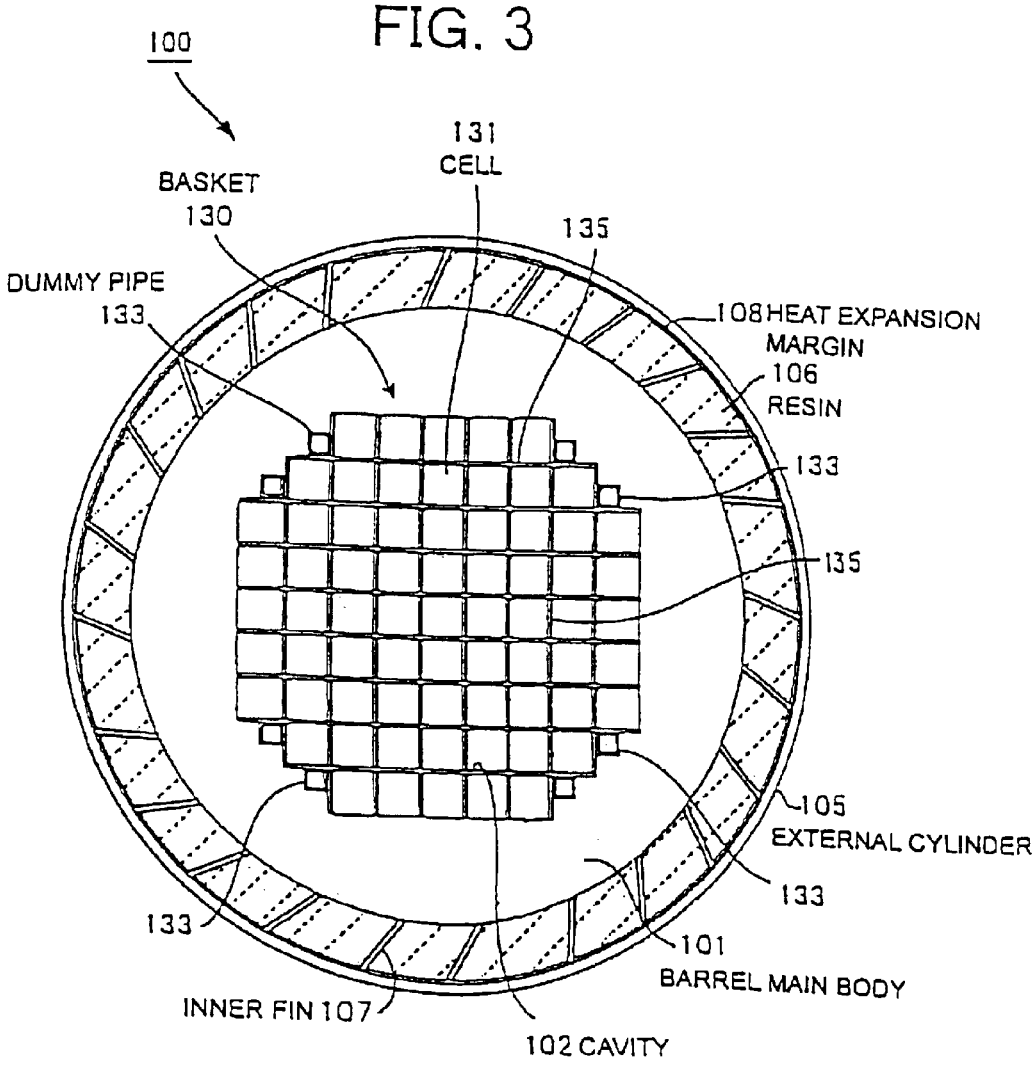
FIG. 3 is a cross sectional view in a diametrical direction showing the cask shown in FIG. 1.

FIG. 1 is a perspective view which shows a cask according to a first embodiment of the present invention. FIG. 2 is a cross sectional view in an axial direction of the cask shown in FIG. 1. FIG. 3 is a cross sectional view in a diametrical direction of the cask shown in FIG. 1. A cask 100 according to the first embodiment is structured such that an inner surface of a cavity 102 of a barrel main body 101 is machined in conformity with an outer peripheral shape of a basket 130. The machining of the inner surface of the cavity 102 is milled by an exclusive working apparatus mentioned below. The barrel main body 101 and a bottom plate 104 correspond to forged products made of a carbon steel having a γ ray shielding function. In this case, in place of the carbon steel, a stainless steel may be employed. The barrel main body 101 and the bottom plate 104 are bonded by welding. Further, in order to secure a sealing performance as a pressure vessel, a metal gasket may be provided between a primary cover 110 and the barrel main body 101.

A resin 106 made of a polymeric material containing a lot of hydrogen and having a neutron shielding function is charged between the barrel main body 101 and an external cylinder 105. Further, a plurality of copper inner fins 107 which provide a heat conduction are welded between the barrel main body 101 and the external cylinder 105, and the resin 106 is poured into a space formed by the inner fins 107 in a fluid state so as to be cooled and solidified. In this case, it is preferable that the inner fins 107 are provided in a portion having a lot of calories at a high density in order to uniformly execute a heat radiation. Further, a heat expansion margin 108 of some mm is provided between the resin 106 and the external cylinder 105. This heat expansion margin 108 is formed by arranging a disappearing mold obtained by inserting a heater or the like in a hot melt adhesive or the like on the inner surface of the external cylinder 105, pouring the resin 106 so as to solidify and thereafter heating the heater so as to melt and discharge the mold (not shown).

A cover section 109 is constituted by a primary cover 110 and a secondary cover 111. The primary cover 110 has a disc shape made of a stainless steel carbon steel shielding the γ ray. Further, the secondary cover 111 also has a disc shape made of a stainless steel or a carbon steel, however, a resin 112 corresponding to a neutron shielding body is sealed on an upper surface thereof. The primary cover 110 and the secondary cover 111 are mounted to the barrel main body 101 by bolts 113 made of a stainless steel or a carbon steel. Further, metal gaskets not shown are provided between the primary cover 110 and the secondary cover 111, and the barrel main body 101, thereby maintaining an internal sealing property. Further, an assist shielding body 115 in which a resin 114 is sealed is provided around the cover section 109.

Trunnions 117 which suspend the cask 100 is provided in both sides of a cask main body 116. In this case, in FIG. 1, there is shown a structure in which the assist shielding body 115 is provided, however, at a time of transferring the cask 100, the assist shielding member 115 is taken out and a buffer body 118 is mounted (refer to FIG. 2). The buffer body 118 corresponds to a structure in which a buffer member 119 such as a redwood material or the like is assembled within an external cylinder 120 prepared by a stainless steel.

Figure 4:
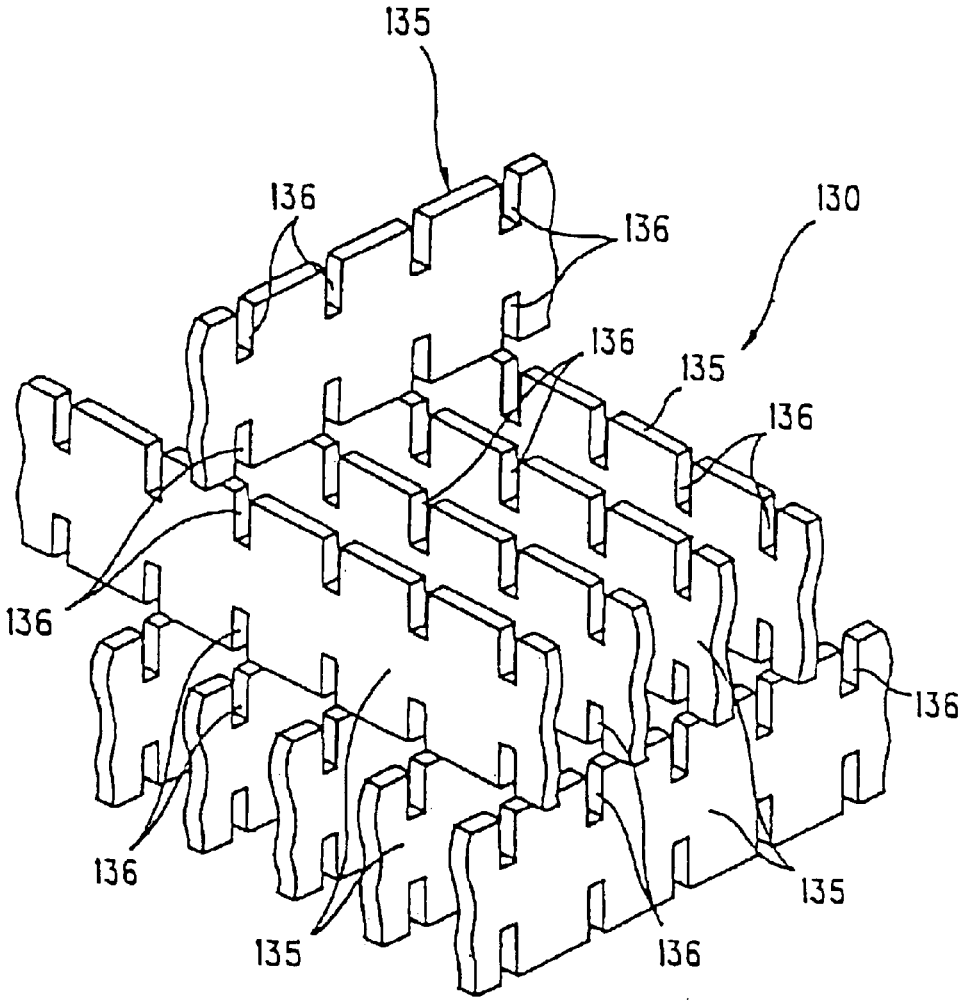
FIG. 4 is an assembly diagram of a basket shown in FIG. 1.

FIG. 4 is an assembly view of the basket shown in FIG. 1. A basket 130 is constructed by alternately piling up rectangular plate-like members 135 vertically. Cutting sections 136 are formed in both sides of the rectangular plate-like members 135 at a fixed interval, and the interval of the cutting sections 136 is determined by a cell width, that is, a width of the spent fuel assembly. The rectangular plate-like members 135 are alternately piled up vertically so that the cutting sections 136 are inserted to each other. Accordingly, the basket 130 having a plurality of cells is totally constructed. Further, the plate-like member 135 employs an aluminum composite material obtained by adding B or B chemical compound powders having a neutron absorbing performance to Al or Al alloy powders, or an aluminum alloy. Further, as the neutral absorbing material, a cadmium can be employed in addition to the boron.

Figure 5:
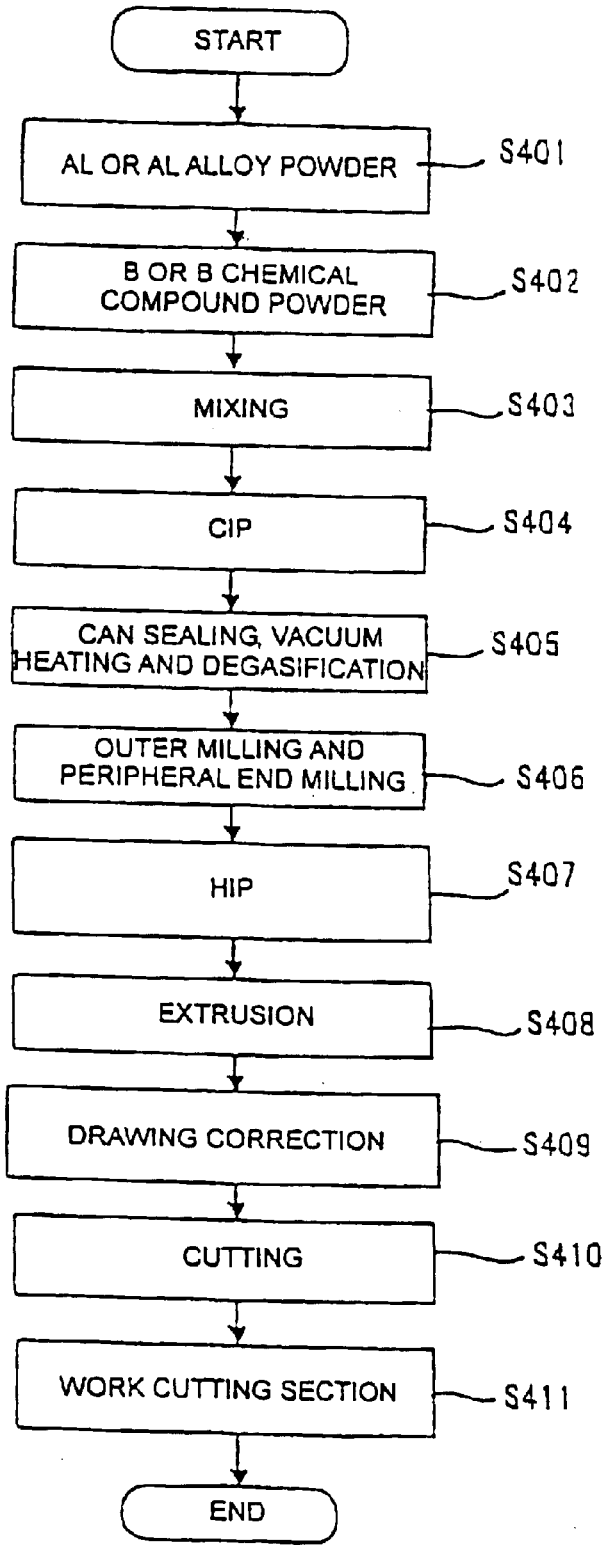
FIG. 5 is a flow chart showing a manufacturing method of a plate-like member.

FIG. 5 is a flow chart showing a manufacturing method of the plate-like member mentioned above. At first, the Al or AL alloy powders are produced according to a rapidly solidifying method such as an atomizing method or the like (step S401), the B or B chemical compound powders are prepared (step S402) and both of these powders are mixed by a cross rotary mixer or the like for ten to fifteen minutes (step S403).

The Al or Al alloy can employ a pure aluminum ingot, an Al—Cu group aluminum alloy, an Al—Mg group aluminum alloy, an Al—Mg—Si group aluminum alloy, an Al—Zn—Mg group aluminum alloy, an Al—Fe group aluminum alloy or the like. Further, the B or B chemical compound can employ a $B_4C$, $B_2O_3$ or the like. In this case, it is preferable to set an amount of adjunction of the boron with respect to the aluminum to be equal to or more than 1.5 weight % or more and equal to or less than 7 weight %. If it is equal to or less than 1.5 weight %, a sufficient neutron absorbing performance can not be obtained, and if it is more than 7 weight %, an extension with respect to drawing is reduced.

Next, the mixed powders are sealed within a rubber case, and a high pressure is uniformly applied from all the directions at a room temperature according to a cold isostatic press (CIP), whereby a powder molding is executed (step S404). The molding condition of the CIP is set such that a molding pressure is 200 Mpa, a diameter of the molded product is 600 mm and a length thereof is 1500 mm. By uniformly applying the pressure from all the directions according to the CIP, it is possible to obtain a molded product having a small dispersion in the molding density and a high density.

Next, the powder molded product is vacuum sealed in a can, and a temperature thereof is increased to 300° C. (step S405). A gas content and a water content within the can are removed according to this degasification step. In the next step, the molded product after being vapor degasified is remolded according to a hot isostatic press (HIP) (step S406) The molding condition of the HIP is set such that a temperature is between 400° C. and 450° C., a time is 30 sec, a pressure is 6000 ton and a diameter of the molded product is 400 mm. Next, in order to remove the can, an outer milling and a peripheral and end milling are applied (step S407), and a billet is hot extruded by using a port hole extruder (step S408). As an extruding condition in this case, a heating temperature is set to 500° C. to 520° C. and an extruding speed is set to 5 m/min. In this case, this condition is properly changed according to a content of B. Next, a drawing cure is applied after the extrusion molding (step S409), an unsteady section and an estimation section are cut so as to obtain the plate member 135 (step S410). Further, a plurality of cutting sections 136 are formed in the plate-like members 135 and according to a machining process (step S411).

Figure 6A:
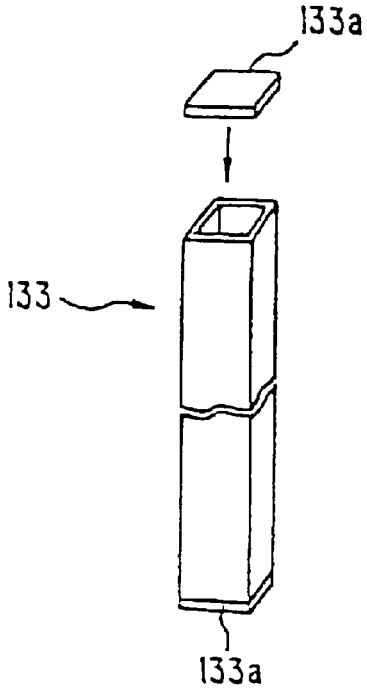
FIG. 6A and FIG. 6B are perspective views which show a dummy pipe.

FIG. 6A is a perspective view which shows the dummy pipe shown in FIG. 3. As shown in FIG. 3, the dummy pipes 133 are respectively inserted to both sides of cell lines having five or seven cells in the cavity 102. The dummy pipes 133 are provided for the purpose of reducing a weight of the barrel main body 101 and uniformizing a thickness of the barrel main body 101. In particular, the uniformization of the thickness is effective with respect to preventing a stress from being concentrated in a specific section of the barrel main body. Further, they can be used for the purpose of securely fixing the basket 130. The dummy pipes 133 employ an aluminum alloy containing boron and are manufactured according to the same steps as those mentioned above.

Further, the dummy pipes 133 are formed in a square pipe shape, however, both ends thereof are closed by covers 133*a* (in FIG. 3, the covers are omitted in illustration) If the covers 133*a* are welded and the inner sections of the dummy pipes 133 are sealed, no pure water come within the dummy pipes 133 at a time of pouring the pure water in the fuel handling facility, so that it is effective for the weight saving of the cask. In particular, the weight of the cask is limited at a time when the cask is suspended from a cask pit in a state that the water is charged within the cask after receiving the fuel, and at a time when the water is poured for the purpose of taking out the fuels and the cask is suspended down to the cask pit, and this means that the weight of the cask at a time of suspending up or suspending down becomes small due to the fact that the pure water does not come within the dummy pipes 133.

Further, another material can be charged in the inner section by sealing the inner section of the dummy pipe 133. For example, it is possible to easily execute a helium gas introducing operation at a time of storing by previously charging the helium gas in the inner section. Further, it is possible to improve a heat conductivity at a time of storing by sealing the helium gas. In this case, when introducing the helium gas, it is preferable that a valve is provided in one cover 133*a*. Further, it is preferable that the valve is sealed after introducing the gas. It is possible to increase the heat conductivity of the cask by sealing a gas or a fluid having a high heat conductivity in addition to the helium gas. Further, the resin mentioned above may be sealed in the inner sections of the dummy pipes 133. According to this structure, it is possible to improve the neutron absorbing performance by effectively utilizing the internal space of the dummy pipes 133 corresponding to the dead space.

Figure 6B:
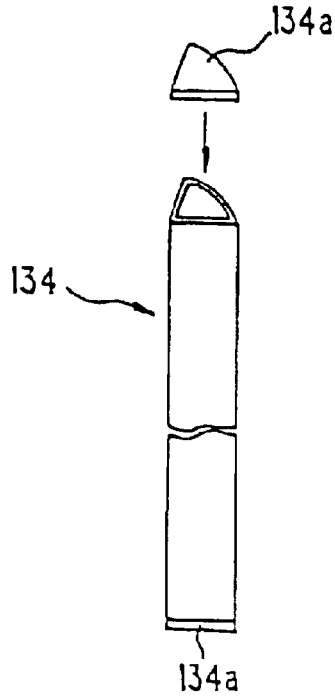

FIG. 6B is a perspective view which shows a modified embodiment of the dummy pipe. As shown in the drawing, the structure may be made such that a cross sectional shape of a dummy pipe 134 is formed in a fan shape. In this case, a dummy pipe corresponding portion of the cavity 102 forms a curved surface (not shown). Further, the inner section can be sealed by welding covers 134*a* to both sides thereof and the helium gas ore the resin can be introduced therein in the same manner as that of the dummy pipe 133 shown in FIG. 6A.

Figure 7A:
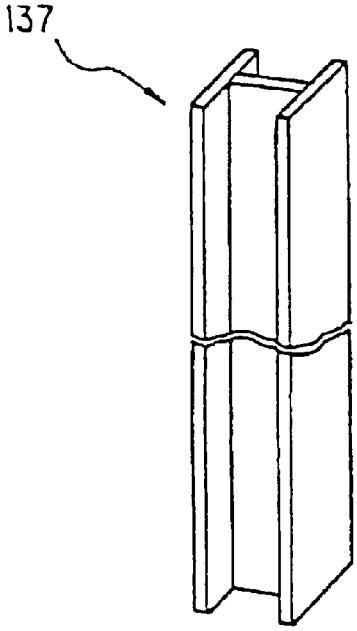
FIG. 7A and FIG. 7B are perspective views which show a modified embodiment of the dummy pipe.
Figure 7B:
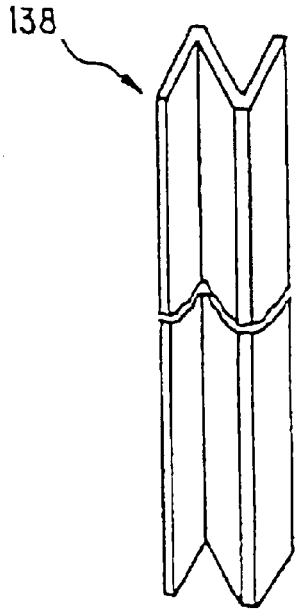

Next, since the dummy pipe 133 is provided for the purpose of uniformizing the thickness of the barrel main body 101 together with reducing the weight of the barrel main body 101 as mentioned above, it is not always necessary to have a sealed structure. Accordingly, the cover 133*a* of the dummy pipe 133 may be omitted, and a dummy member 137 in which a cross sectional shape is formed in an H shape can be alternatively used, as shown in FIG. 7A. Further, it is possible to employ a dummy member 138 in which a cross sectional shape is formed in an N shape, as shown in FIG. 7B. In particular, when the cross sectional shape is formed in the N shape, it is possible to securely fix the basket 130 by inserting it due to an elastically deformation. In this case, the dummy member 133 may be omitted.

Figure 8:
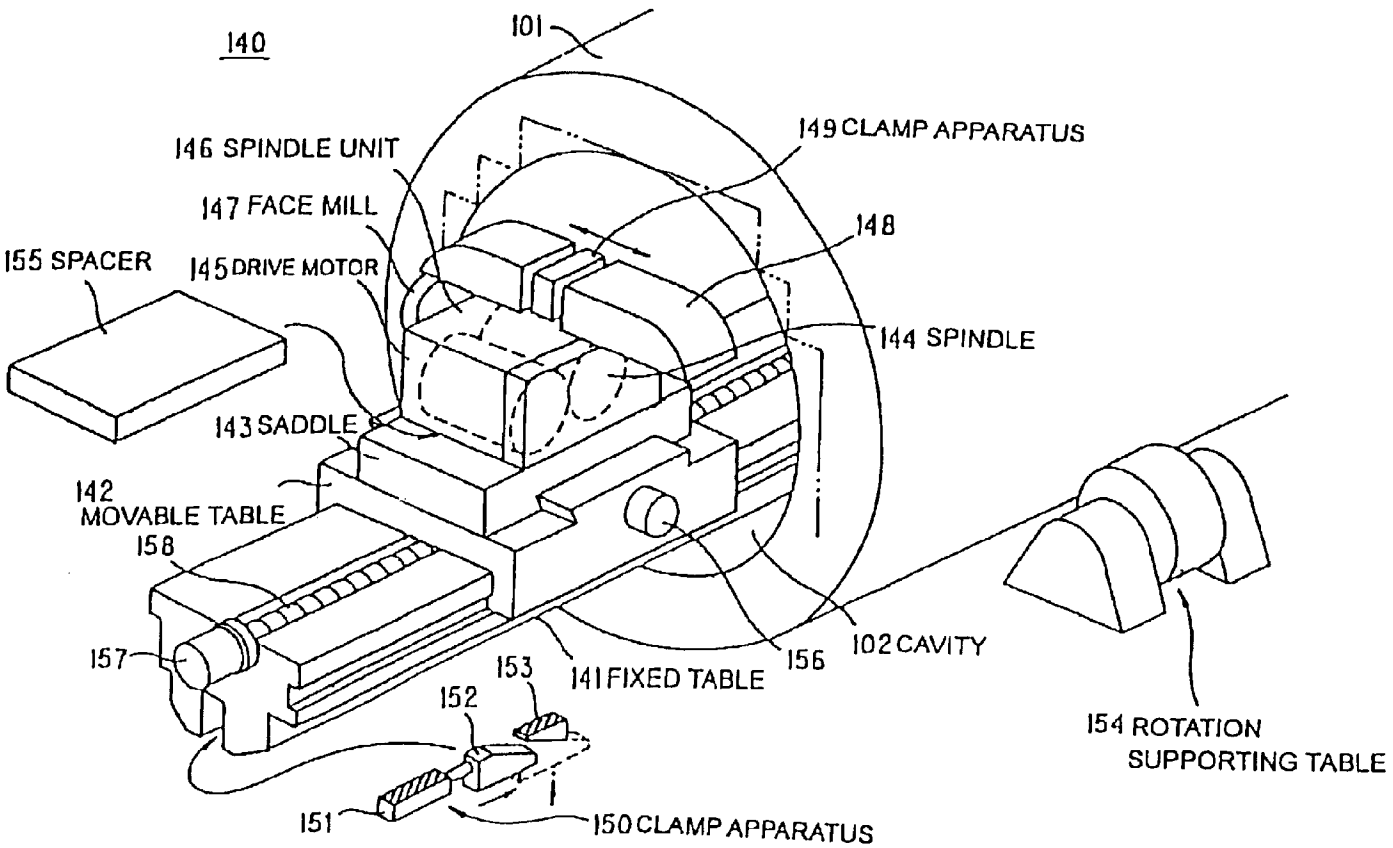
FIG. 8 is a schematic perspective view which shows a working apparatus of a cavity.

Next, a description will be given of a process of the cavity 102 in the barrel main body 101. FIG. 8 is a schematically perspective view which shows a working apparatus of the cavity 102. A working apparatus 140 is constituted by a fixed table passing through the inner section of the barrel main body 101 and mounted and fixed within the cavity 102, a movable table 142 sliding in an axial direction on the fixed table 141, a saddle 143 positioned and fixed on the movable table 142, a spindle unit 146 provided on the saddle 143 and having a spindle 144 and a drive motor 145, and a face mill 147 provided in a spindle shaft. Further, a reaction force receiver 148 in which a contact section is formed in correspondence to an inner shape of the cavity 102 is provided on the spindle unit 146. This reaction force receiver 148 is detachably provided and slides in a direction of an arrow in the drawing along a dovetail groove (not shown). Further, the reaction force receiver 148 has a clamp apparatus 149 against the spindle unit 146, and can be fixed at a predetermined position.

Further, a plurality of clamp apparatus 150 is mounted within a lower groove of the fixed table 141. The clamp apparatus 150 is constituted by a hydraulic cylinder 151, a wedge-like moving block 152 provided in a shaft of the hydraulic cylinder 151, and a fixed block 153 brought into contact with the moving block 152 on an inclined surface, and is structured such as to mount a hatched section in the drawing to a groove inner surface of the fixed table 141. When driving the shaft of the hydraulic cylinder 151, the moving block 152 is brought into contact with the fixed block 153, and the moving block 152 moves slightly downward due to an effect of the wedge (shown by a dotted line in the drawing). Accordingly, since a lower surface of the moving block 152 is pressed against the inner surface of the cavity 102, it is possible to fix the fixed table 141 within the cavity 102.

Further, the barrel main body 101 is mounted on a rotation supporting table 154 constituted by a roller, and can freely rotate in a diametrical direction. Further, it is possible to adjust a height of the face mill 147 on the fixed table 141 by inserting a spacer 155 between the spindle unit 146 and the saddle 143. The saddle 143 moves in a diametrical direction of the barrel main body 101 by rotating a handle 156 provided in the movable table 142. The movable table 142 is moved and controlled by a servo motor 157 provided in an end section of the fixed table 141 and a ball screw 158. In this case, since the shape within the cavity 102 is changed according to the working is progressed, it is necessary to change the reaction force receiver 148 and the moving block 152 of the clamp apparatus 150 to a proper shape.

Figure 9A:
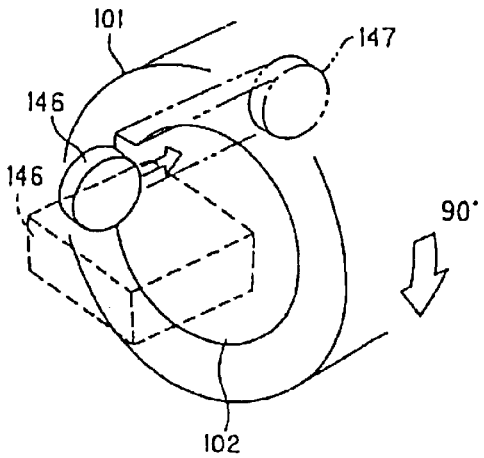
FIG. 9A to FIG. 9D are schematic perspective views which show a working method of the cavity.
Figure 9B:
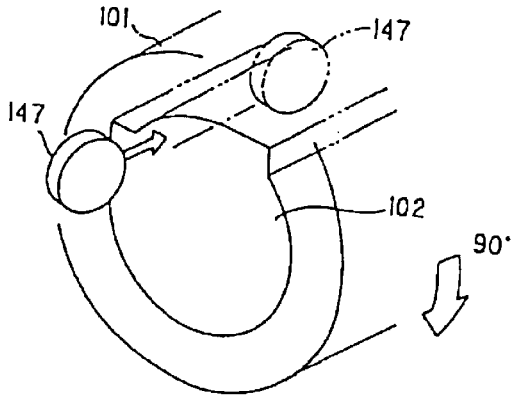

FIG. 9A to FIG. 9D are schematically explanatory views which show a working method of the cavity. At first, the fixed table 141 is fixed at a predetermined position within the cavity 102 by the clamp apparatus 150 and the reaction force receiver 148. Next, as shown in FIG. 9A, the spindle unit 146 is moved along the fixed table 141 at a predetermined cutting speed, thereby cutting the inner section of the cavity 102 by the face mill 147. When the cutting operation at the position is completed, the fixed table 141 is released by taking out the clamp apparatus 150. Next, as shown in FIG. 9B, the barrel main body 101 is rotated at 90 degrees on the rotation supporting table 154, and the fixed table 141 is fixed by the clamp apparatus 150. Further, the cutting operation is executed by the face mill 147 in the same manner as mentioned above. Hereinafter, the same steps mentioned above are further repeated twice.

Figure 9C:
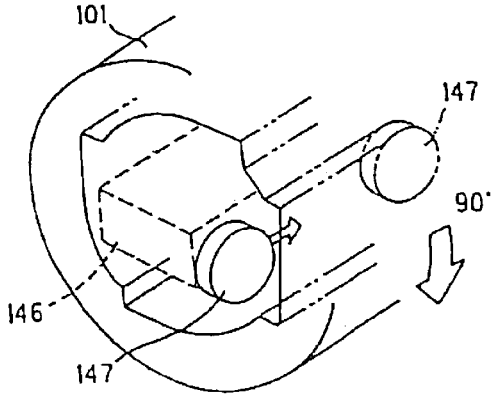
Figure 9D:
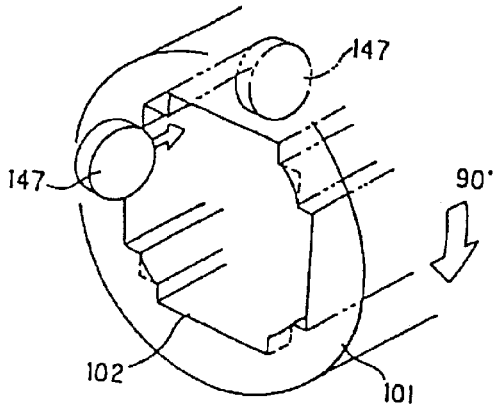

Next, the spindle unit 146 is rotated at 180 degrees, thereby sequentially cutting the inner section of the cavity 102 as shown in FIG. 9C. In this case, in the same manner as mentioned above, the working process is also repeating while rotating the barrel main body 101 at 90° C. Next, as shown in FIG. 9D, the position of the spindle unit 146 is made high by inserting the spacer 155 in the spindle unit 146. Further, the face mill 147 is fed in an axial direction at the position, thereby cutting the inner section of the cavity 102. By repeating this while rotating at 90 degrees, a shape necessary for inserting the basket 130 is substantially completed. In this case, the portion to which the dummy pipe 133 is inserted may be cut in the same manner as shown in FIG. 9D. However, a thickness of the spacer adjusting the height of the spindle unit 146 is set to the same as one line of the dummy pipe 133.

Since the spent fuel assembly received in the cask 100 includes a fissile material, a fission product and the like and generates a radiation and a decay heat, it is possible to securely maintain a heat removing function, a shielding function and a critical preventing function of the cask 100 during a storage period (about sixty years). In the cask 100 according to the first embodiment, the structure is made such that the inner side of the cavity 102 of the barrel main body 101 is machined so as to insert the outer peripheral surface of the basket 130 in a closely attached state (substantially with no space), and the inner fins 107 are provided between the barrel main body 101 and the external cylinder 105. Accordingly, the heat output from the fuel rod is conducted to the barrel main body 101 through the basket 130 or the charged helium gas, and is radiated from the external cylinder 105 mainly through the inner fins 107. According to the structure mentioned above, a coefficient of heat conductivity from the basket 130 is improved and it is possible to effectively remove the decay heat.

Further, the γ rays generated from the spent fuel assembly is shielded by the barrel main body 101, the external cylinder 105, the cover section 109 and the like which are made of the carbon steel or the stainless steel. Further, the neutron is shielded by the resin 106, whereby an influence due to bombing is not applied to a radiation business operator. In particular, a design is made so that it is possible to obtain a shielding function in which a coefficient of equivalence of surface ray is equal to or less than 2 mSv/h and a coefficient of equivalence of ray amount having a depth 1 m from the surface is equal to or less than 100$\mu$ Sv/h. Further, since the aluminum alloy containing boron is employed in the plate-like member constituting the cell 131 it is possible to absorb the neutron so as to prevent from reaching the critical state.

Figure 25:
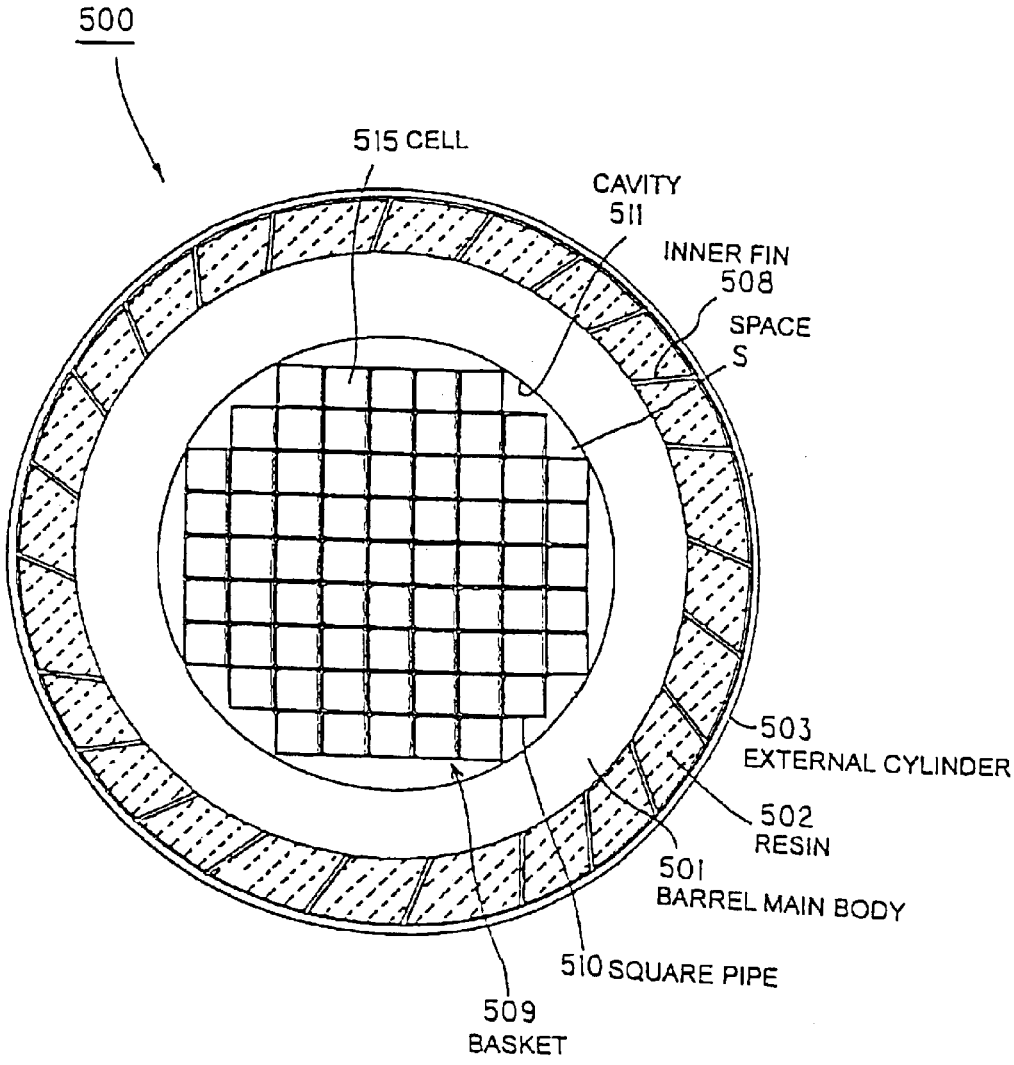
FIG. 25 is a cross sectional view in an axial direction showing the cask shown in FIG. 24.

As mentioned above, according to the cask 100 of the present first embodiment, since the structure is made such that the inner side of the cavity 102 of the barrel main body 101 is machined so as to insert the outer peripheral surface of the basket 130 in the substantially close attached state, it is possible to improve the coefficient of heat conductivity. Further, since the space within the cavity 102 can be lost, it is possible to make the barrel main body 101 compact and light. Here, even in this case, the receiving number of the spent fuel assemblies is not reduced. On the contrary, if the outer diameter of the barrel main body 101 is set to be the same as that of a cask 500 shown in FIG. 25, the number of the cells can be secured at that degree, so that it is possible to increase the receiving number of the spent fuel assemblies. In particular, in the cask 100, it is possible to set the receiving number of the spent fuel assemblies to sixty nine, and it is possible to restrict the outer diameter of the cask main body 116 to 2560 mm and the weight thereof to 120 tons. Further, as an actual problem, by employing the structure mentioned above, it is possible to receive sixty nine spent fuel assemblies while satisfying the required weight restriction and size restriction.

Figure 10:
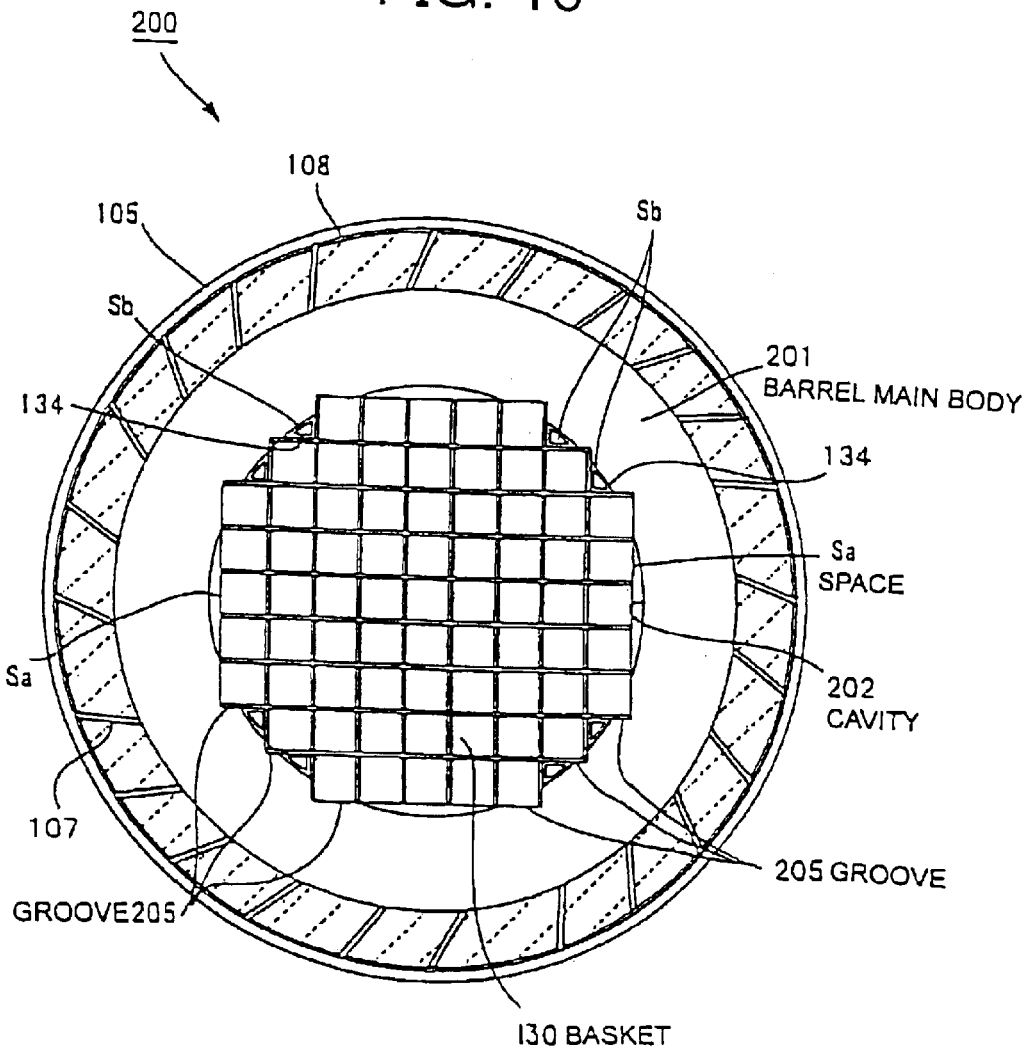
FIG. 10 is a cross sectional view in a diametrical direction showing a modified embodiment of the cask.

FIG. 10 is a cross sectional view which shows a modified embodiment of the cask mentioned above. In a barrel main body 201 of a cask 200, in place that an inner side of a cavity 202 is flat worked so that the outer peripheral surface of the basket 130 is completely brought into contact therewith, it is worked so that a part thereof is brought into contact therewith and little spaces Sa and Sb are left. That is, a plurality of grooves 205 formed so that a part of the basket 130 is engaged are worked with respect to twelve positions of the cavity 202 in which the inner section of the cavity 202 is formed in a cylindrical shape. Further, a dummy pipe having a shape corresponding to a shape of a space formed between the cavity 202 and the basket 130 is inserted to the space Sb (the dummy pipe 134 shown in FIG. 6A is preferable).

Figure 24:
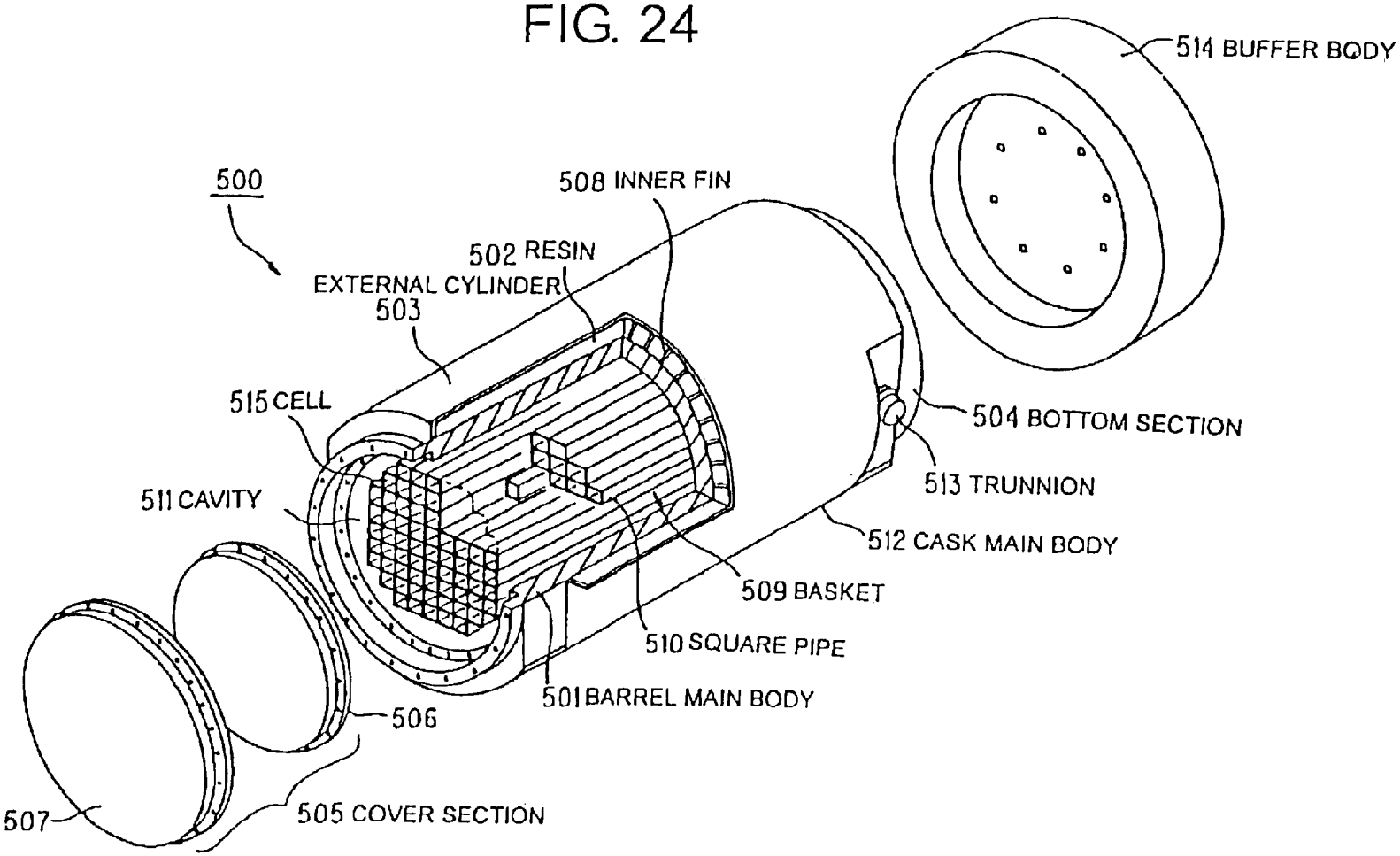
FIG. 24 is a perspective view which shows an example of a cask.

According to the structure mentioned above, since a working amount of the barrel main body 201 applied by the working apparatus can be reduced, a productivity is improved. Further, since a portion in which the basket 130 is directly brought into contact with the barrel main body 201 is increased, and the spaces Sa and Sb within the cavity 202 can be reduced, it is possible to improve the coefficient of heat conductivity in comparison with the cask 500 shown in FIGS. 24 and 25 while being less than the cask 100 according to the first embodiment. Further, it is possible to make the cask 200 compact and light. In this case, since the other constituting elements are the same as those of the cask 100 according to the first embodiment mentioned above, the description thereof will be omitted.

Figure 11:
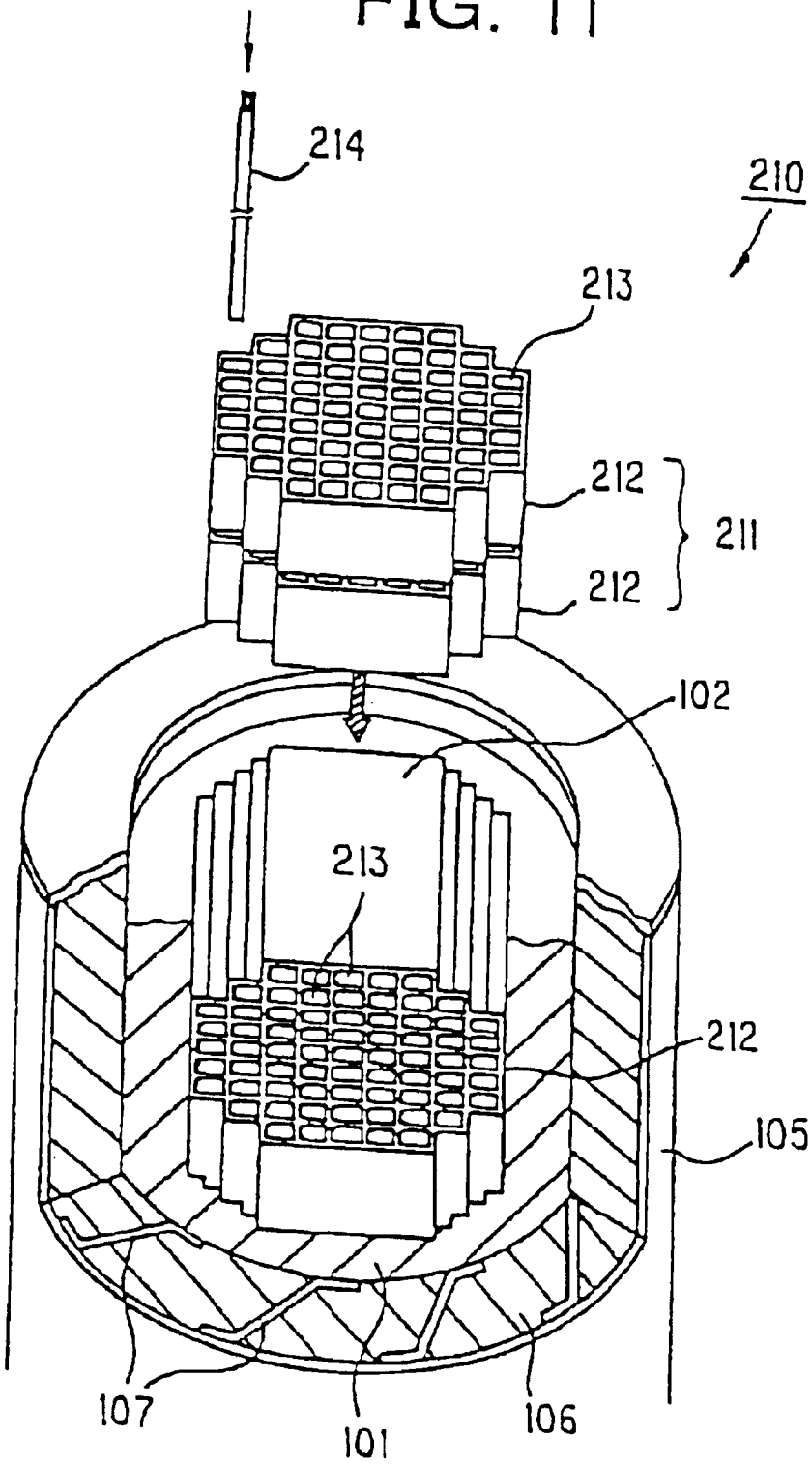
FIG. 11 is a schematic view which shows a cask according to a second embodiment of the present invention.

FIG. 11 is an explanatory view which shows a cask according to a second embodiment of the invention. In this cask 210, there exists a feature in a point of using a basket 211 having an integrally cast structure. Since the other structures are the same as those of the cask 100 according to the first embodiment, a description thereof will be omitted and the same reference numerals are attached to the same constituting elements. The cast basket 211 is formed by forming a whole of the cast basket 211 in a block unit and piling up them. A block 212 is integrally formed according to a casting, and a cell 213 receiving the spent fuel assembly is formed by applying a machining process to the block 212. For example, the cell 213 can be formed by using an electric discharge machining or a wire cutting. Further, at a time of casting, the cell 213 may be formed by using a core.

The block 212 formed in the manner mentioned above is received within the cavity 102 in a piling up manner as shown in FIG. 11. The block 212 is inserted within the cavity 102 in a laminated manner so as to construct the cast basket 211, and in this state, a dummy pipe 214 is inserted. The dummy pipe 214 has the same structure as that disclosed in the first embodiment, and a shape thereof can suitably select and employ the shapes disclosed in FIG. 6A to FIG. 7B. By using the dummy pipe 214, even when using the cast basket 211, it is possible to uniformize the thickness of the barrel main body 101 as well as reducing the weight of the barrel main body 101.

As a casting method suitable for the cast basket 211, it is preferable to use a pressure application casting method performed by a metal casting mold in view of a size accuracy or the like. Further, it is also possible to obtain a good basket having a little blow hole even according to a vacuum casting method. For the material of the cast basket 211, a material obtained by adding the boron to the aluminum or the aluminum alloy is employed. The Al or Al alloy can employ a pure aluminum ingot, an Al—Cu aluminum alloy, an Al—Mg aluminum alloy, an Al—Mg—Si aluminum alloy, an Al—Zn—Mg aluminum alloy, an Al—Fe aluminum alloy or the like. Further, the B or B chemical compound can employ a $B_4C$, $B_2O_3$ or the like. In this case, it is preferable to set an amount of adjunction of the boron with respect to the aluminum to be equal to or more than 1.5 weight % or more and equal to or less than 7 weight %. If it is equal to or less than 1.5 weight %, a sufficient neutron absorbing performance can not be obtained, and if it is more than 7 weight %, an extension with respect to drawing is reduced.

Figure 12A:
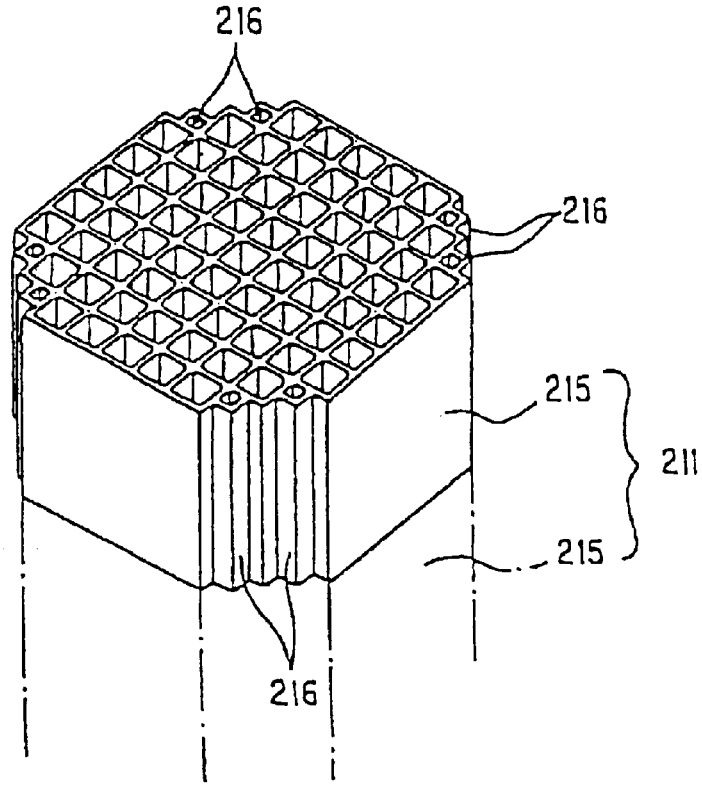
FIG. 12A and FIG. 12B are perspective views which show a modified embodiment of a casting block.
Figure 12B:
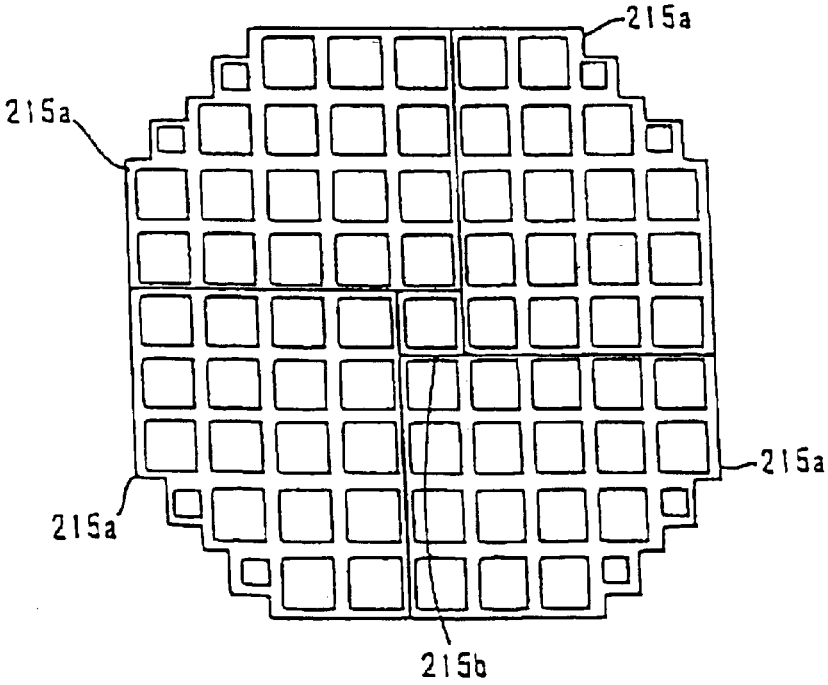

FIG. 12A is a perspective view which shows a modified embodiment of a cast block. The cast block 215 has a feature in a point that a section (a dummy cell 216) corresponding to the dummy pipe is integrally cast. According to the structure mentioned above, since it is possible to save the trouble of independently manufacturing the dummy pipe so as to insert, the structure and an assembling work become simple. Further, since a contact interface between the basket and the dummy pipe is lost, the efficiency of heat conduction is improved. The cast block 215 shown in FIG. 12A is structured such that the dummy cell 216 has a hollow structure, however, it may have a solid structure (an illustration is omitted). Further, the cast block 215 may be constituted by blocks 215*a* separated into four pieces in a peripheral direction and one pipe 215*b* placed in a center, as shown in FIG. 12B. According to the structure mentioned above, it is possible to manufacture the cast block 215 in correspondence to a capacity of a casting equipment. As mentioned above, by receiving the cast basket 211 within the cavity 102 in a substantially close attached state, it is possible to improve the efficiency of heat conductivity from the cast basket 211 to the barrel main body 101. Further, since it is possible to omit the space within the cavity 102, it is possible to make the barrel main body 101 compact and light.

Figure 13A:
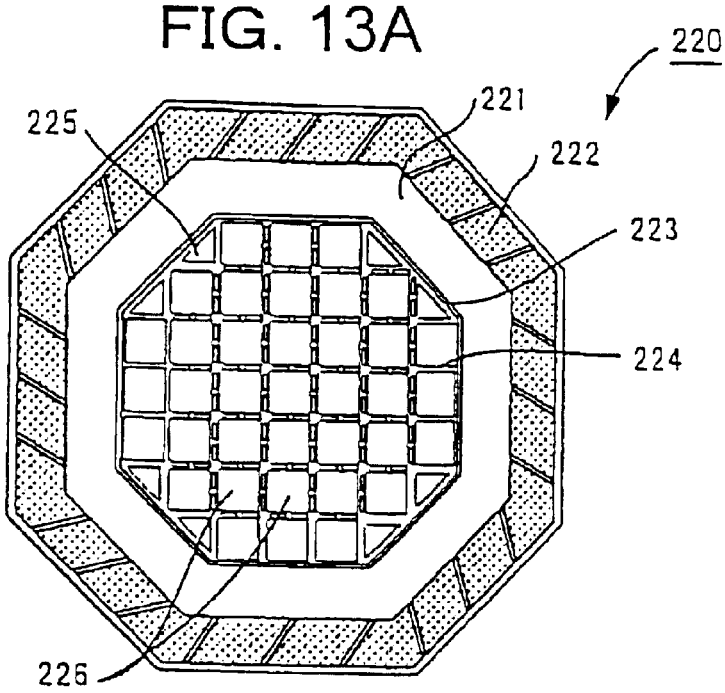
FIG. 13A and FIG. 13B are schematic views which show a modified embodiment of the cask shown in FIG. 11, FIG. 14A to FIG. 14C are schematic views which show a modified embodiment of the cask shown in FIG. 11, FIG. 15A and FIG. 15B are schematic views which show a modified embodiment of the cask shown in FIG. 11, FIG. 16A and FIG. 16B are schematic views which show a modified embodiment of the cask shown in FIG. 11.
Figure 13B:
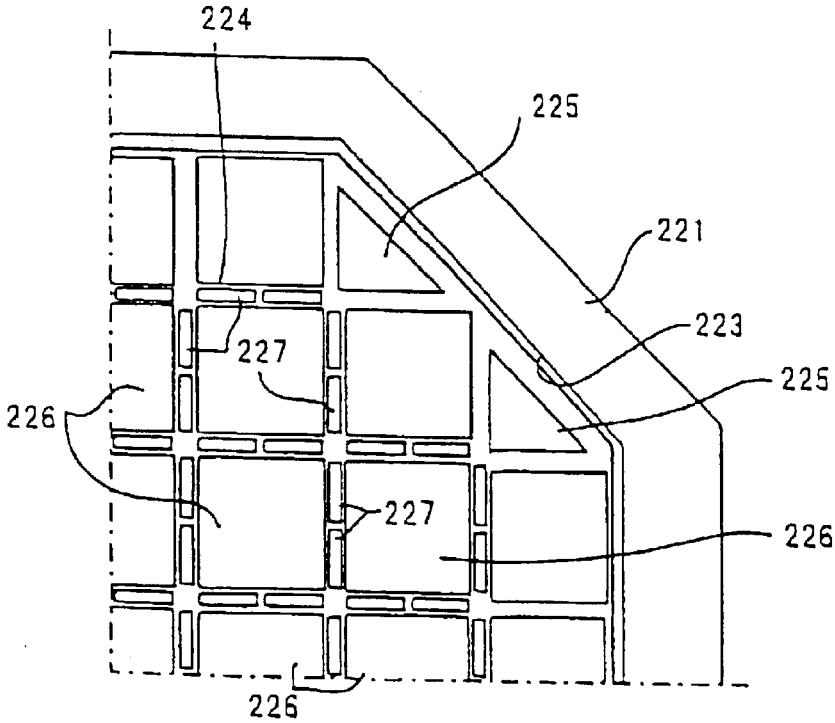

FIG. 13A to FIG. 16B are explanatory views which show modified embodiments of the cask mentioned above. A cask 220 shown in FIG. 13A is used for PWR, and is structured such that a barrel main body 221 and a neutron shielding body 222 are formed in a regular octagonal shape and a basket having an integrally cast structure is inserted within a cavity 223 thereof. The cast basket 224 constituted by the material obtained by adding the boron to the aluminum or the aluminum alloy in the same manner as mentioned above. Further, in order to charge a space generated between the cavity 223 and the cast basket 224, a dummy cell 225 having a triangular cross sectional shape is integrally formed (refer to an enlarged view in FIG. 13B). Accordingly, an outer shape of the cast basket 224 becomes the regular octagonal shape, and is received in the cavity 223 having the same regular octagonal shape in a substantially close attached state. A through hole 227 through which the pure water and the helium gas flow is formed between the cell 226 and the cell 226.

The cell 226 and the through hole 227 of the cast basket 224 are formed according to the machining process such as the electric discharge machining, the wire cutting or the like. Further, the point that the cast blocks are piled up so as to form the cast basket 224 is the same as that of the cast basket 211 mentioned above. In this cask 220, thirty seven cells 226 each of which receives the spent fuel assembly are formed, and eight dummy cells 225 are uniformly arranged at four corners of the cast basket 224. Further, a cover may be provided in the dummy cell 225 so as to seal an interior section, or the helium or the resin may be sealed in the inner section (not shown). Further, in the drawing, the inner section of the dummy cell 225 is hollow, however, it may be solid. It is preferable to suitably determine whether or not the dummy cell 225 is provided, the shape thereof, whether or not the cover is provided and the like, on the basis of conditions such as a weight limitation, a strength, a heat conduction and the like which are required in the cask.

Figure 14A:
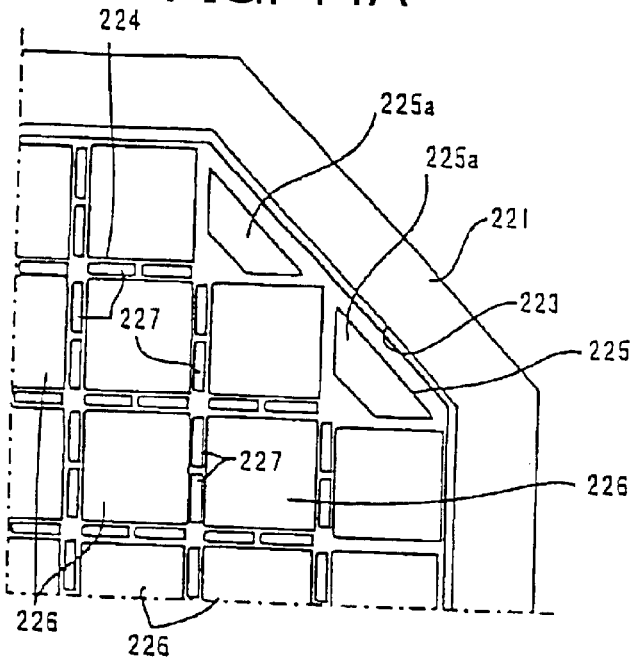
Figure 14B:
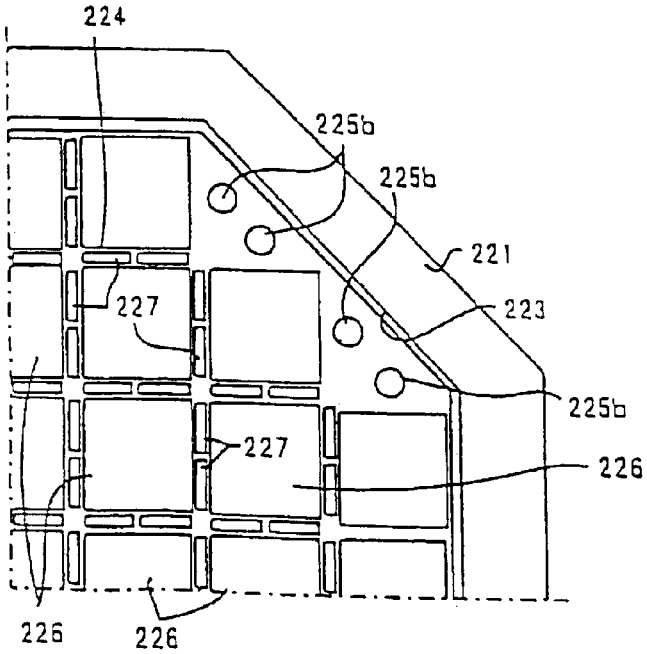
Figure 14C:
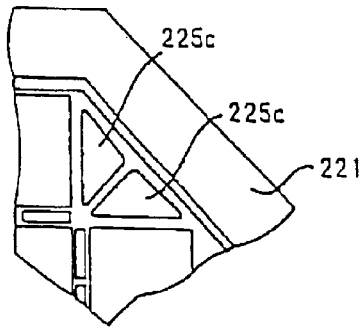
Figure 15A:
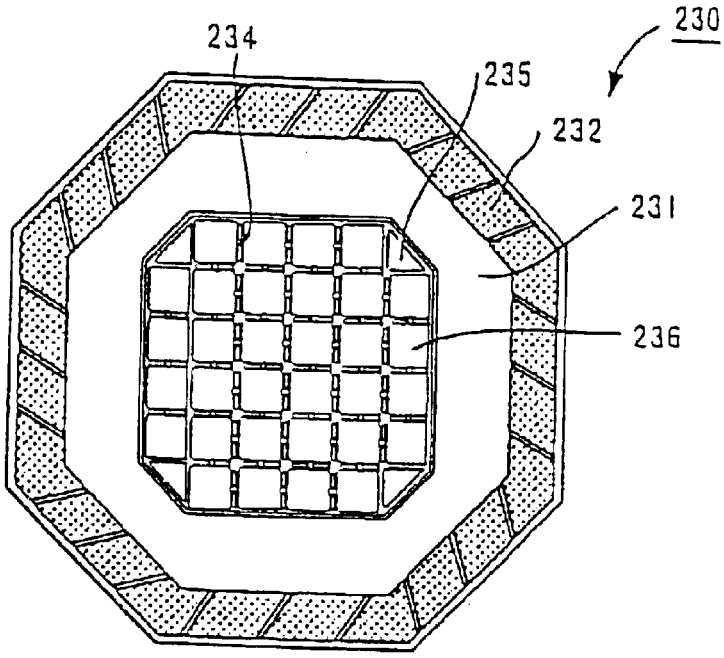
Figure 15B:
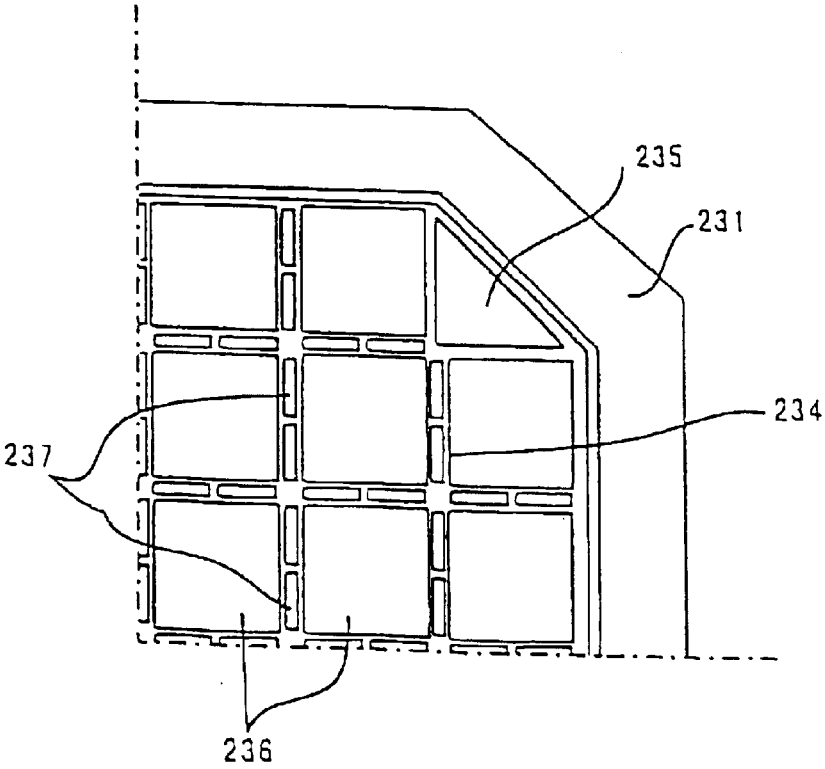

Further, with respect to the shape of the dummy cell 225, the cross sectional shape is not necessarily regular triangle, for example, as shown in FIG. 14A, it may be constituted by a fan-shaped cell 225*a*, or as shown in FIG. 14B, it may be constituted by a plurality of circular cells 225*b*. Further, as shown in FIG. 14C, it may be constituted by two triangular cells 225*c*. Next, a cask 230 shown in FIG. 15A is structured such that thirty two cells 236 each of which receives the spent fuel assembly are formed, and a barrel main body 231 and a neutron shielding body 232 are formed in an octagonal shape. Four dummy cells 235 (refer to an enlarged view in FIG. 15B) are uniformly arranged at four corners of a basket 234. A through hole 237 through which the pure water and the helium gas flow is formed between the cell 236 and the cell 236.

Figure 16A:
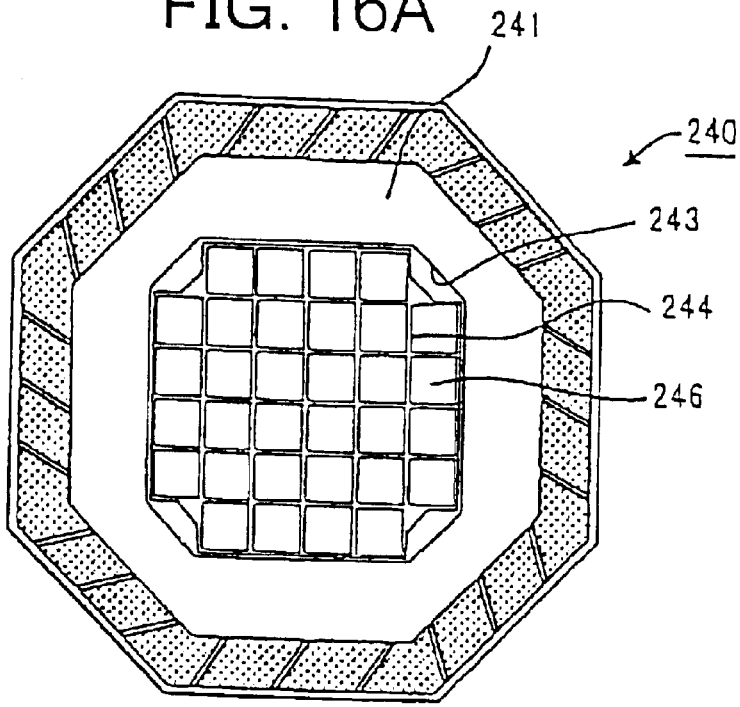
Figure 16B:
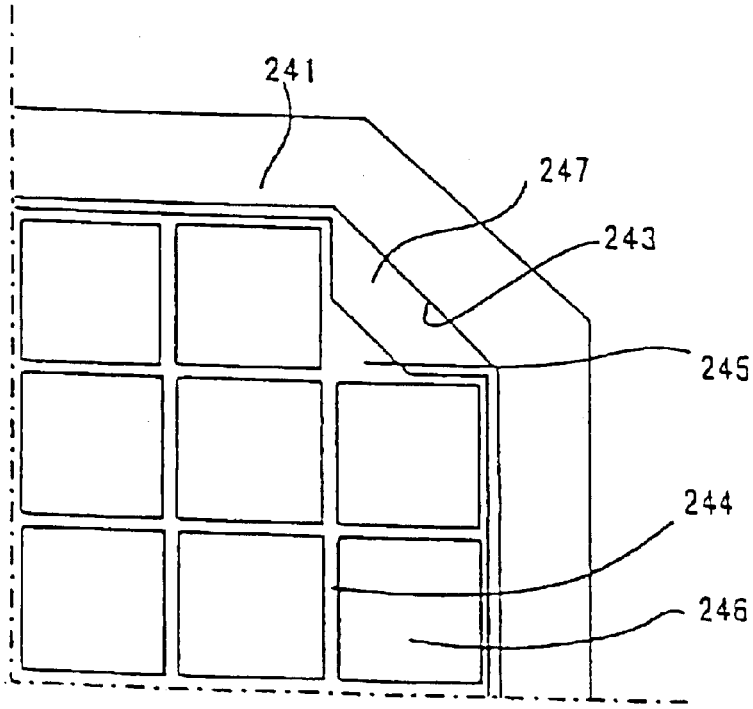

A cask 240 shown in FIG. 16A is structured such that thirty two cells 246 each of which receives the spent fuel assembly are formed. Solid sections 245 which are not in contact with a cavity 243 at four corner sections are formed in an outer side of a cast basket 244 (refer to an enlarged view in FIG. 16B), and a predetermined space 247 is formed with respect to the surface of the cavity 243. Accordingly, there can be obtained an advantage that the cask 240 can be made light in comparison with the instance of it being made completely solid. On the contrary, a side surface section of the cast basket 244 is flush and becomes in a substantially close attached state with an inner surface of the cavity 243. Accordingly, it is possible to smoothly execute a heat conduction from the cast basket 244 to the barrel main body 241. Further, since it is possible to make the space within the cavity 243 small, it is possible to make the cask 240 compact.

Figure 17:
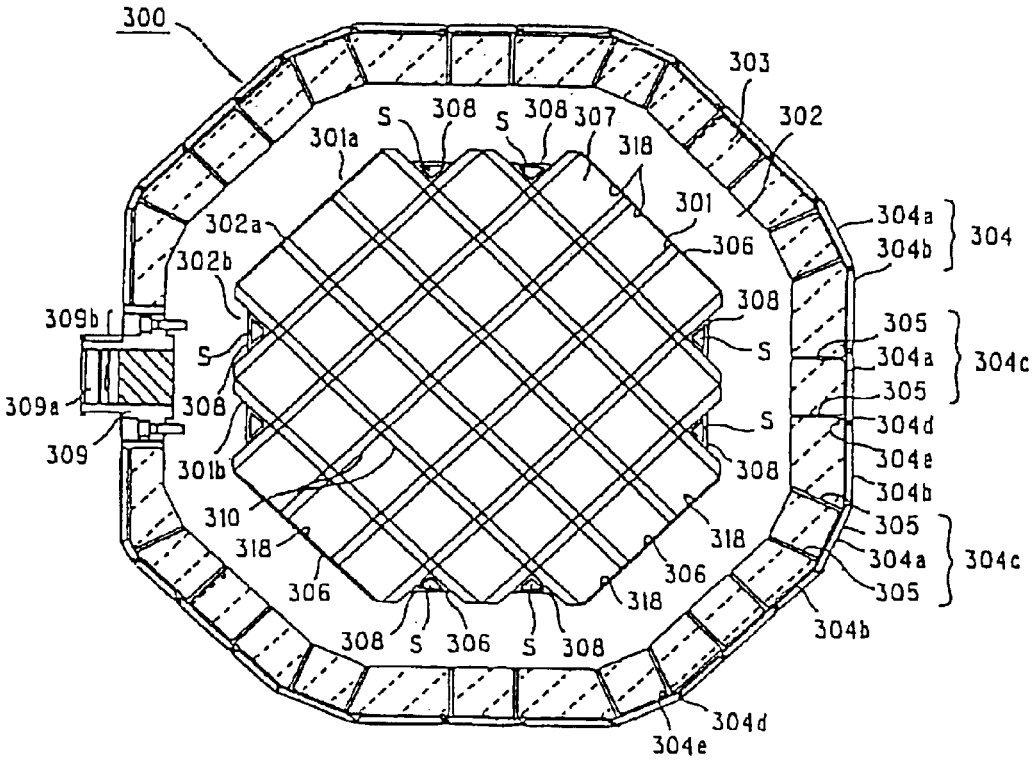
FIG. 17 is a cross sectional view in a diametrical direction showing a cask according to a third embodiment of the present invention.

FIG. 17 is a cross sectional view in a diametrical direction showing a cask according to the third embodiment of the invention. This cask 300 is used for PWR, and is structured such that a basket 301 having a box-of-cake shape is received within a cavity 306 having an inner shape corresponding to an outer shape of the basket 301. Further, an outer shape of the barrel main body 302 is formed in a substantially regular octagonal shape, and a neutron shielding body 303 constituted by a resin is provided in the periphery thereof. The neutron shielding body 303 is charged in a space sectioned by a plurality of heat conducting fins 305 extended between the barrel main body 302 and an external cylinder 304. In this case, a honeycomb body made of an aluminum or a copper may be arranged within the space, and the neutron shielding body may be pressure inserted and charged within the honeycomb.

The external cylinder 304 has a separated structure, and is extended to the heat conduction fin 305 welded to the barrel main body 302 so as to be welded. In preferable, as shown in FIG. 17, the heat conducting fin 305 is welded to both end edges of a rectangular external cylinder member 304*a* so as to form a unit 304*c* having a C-shaped cross sectional shape, and is welded to the barrel main body 302 in a state of being united. Further, the unit 304*c* is welded at a fixed interval, and finally a rectangular external cylinder member 304*b* is extended between the external cylinder members 304*a* of the unit 304*c* so as to be welded from an external section. According to the assembling method mentioned above, since it is not necessary to execute the welding operation within an extremely narrow space and it is possible to weld almost from the external section, it is possible to make the welding operation simple.

Further, when constructing the unit 304*c* in the manner mentioned above, it is possible to prevent a heat affected zone from being locally concentrated by moving a welded section 304*d* between the external cylinder members 304*a* and 304*b* apart from a welded section 304*e* between the heat conducting fin 305 and the external cylinder member 304*a*. Further, in addition to the mounting method, the structure may be made such that all the heat conducting fins 305 are welded to the barrel main body 302 and thereafter the rectangular external cylinder members are sequentially welded to outer peripheral side end edges of the heat conducting fins 305. In this case, the barrel main body 302 is a forged product made of the stainless steel or the carbon steel in the same manner as that of the cask 100 according to the first embodiment.

Figure 18:
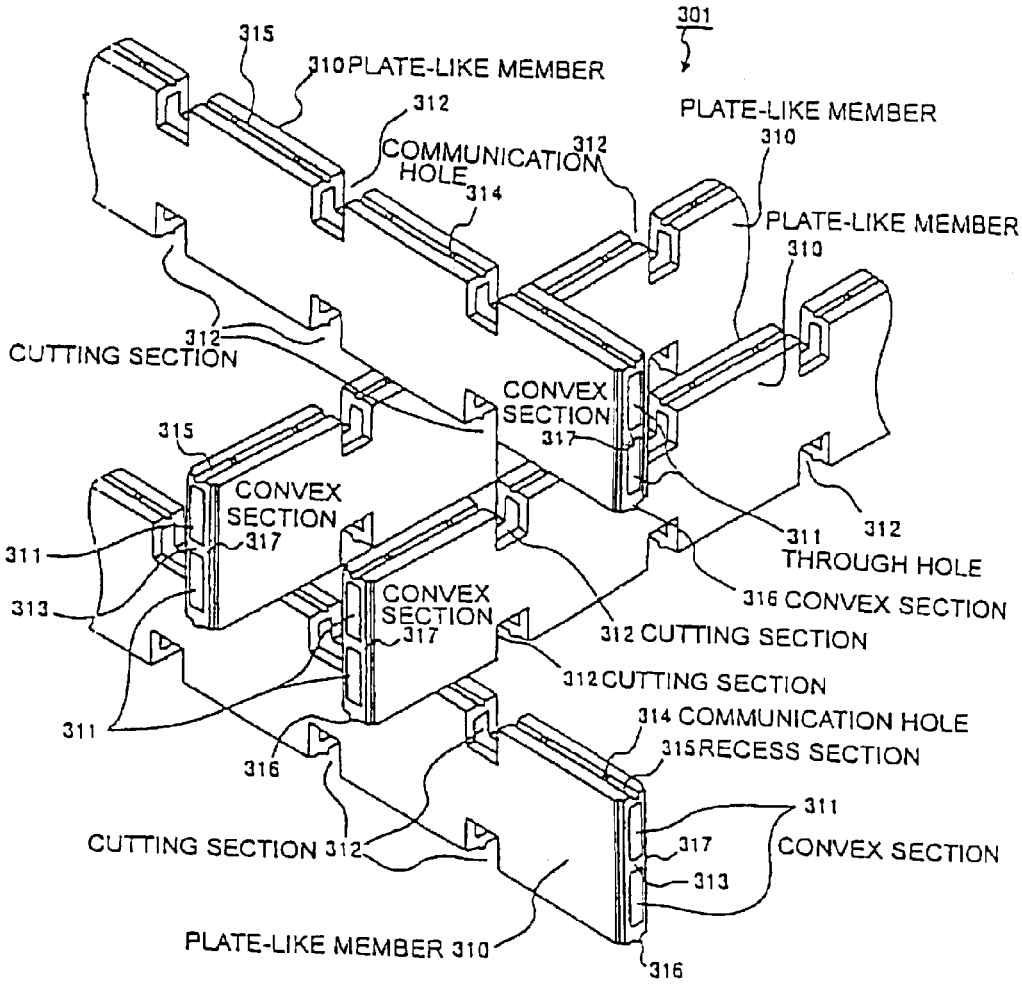
FIG. 18 is a schematic view which shows a structure of a basket.

Next, an inner section of a cavity 306 is formed in a shape corresponding to the outer shape of the basket 301. FIG. 18 is an explanatory view which shows a structure of the basket. The basket 301 is constructed by providing cutting sections 312 in rectangular plate-like members 310 having through holes 311 and alternately piling up the plate-like members 310 vertically. According to this structure, a plurality of cells 307 each of which receives the spent fuel assembly are formed. The through holes 311 are formed in a longitudinal direction of the plate-like members 310 so that a cross sectional shape is formed in a lattice shape, and a plurality of communication holes are formed in center ribs 313 thereof (not shown). Further, the through holes 311 are communicated with the through holes 311 in the other plate-like members 310 by cutting sections 312. Further, communication holes 314 which communicate the through holes 311 of the vertically positioned plate-like members 310 with each other are provided in end surfaces in a longitudinal direction of the plate-like members 310. In this case, the plate-like members 310 having the lattice cross sectional shape are employed here, however, it is possible to employ plate-like members having an arrow lattice cross sectional shape by increasing the number of the ribs (not shown). According to the structure mentioned above, it is possible to increase a rigidity of the plate-like members.

Figure 19:
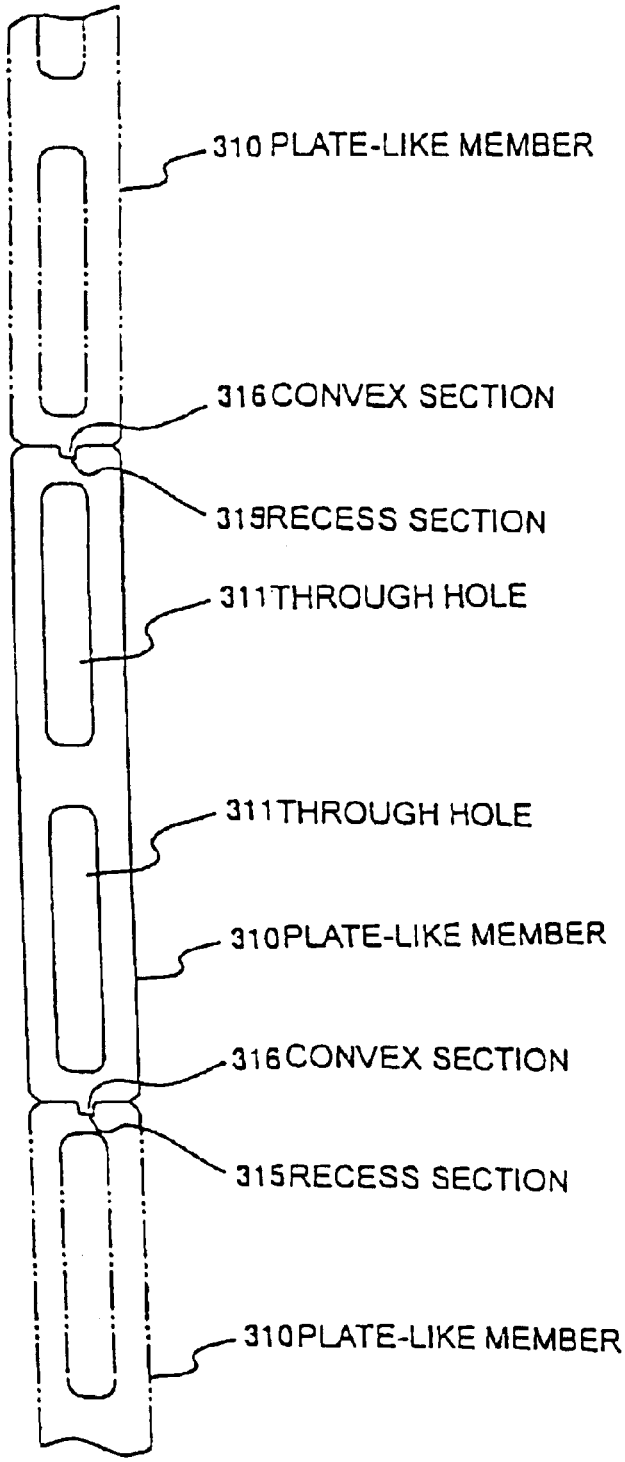
FIG. 19 is a schematic view which shows an assembled state of a plate-like member.
Figure 20:
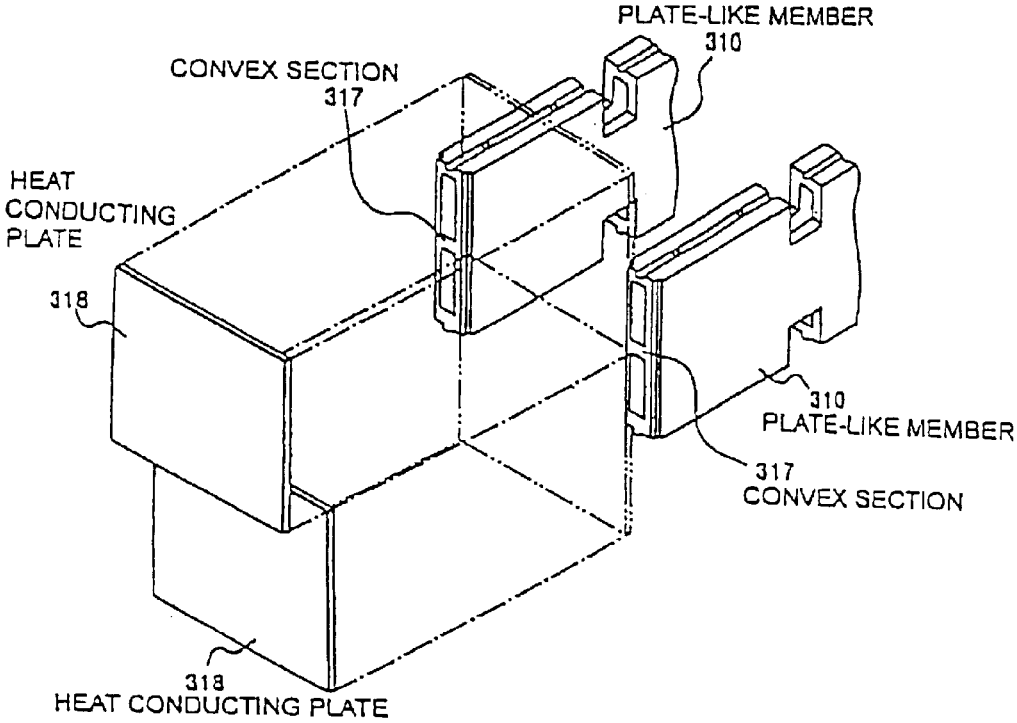
FIG. 20 is an assembly diagram of a heat conduction plate mounted to the plate-like member.

Further, a recess section 315 and a convex section 316 are formed in upper and lower end edges of the plate-like member 310. The plate-like members 310 positioned vertically are positioned by the recess section 315 and the convex section 316 (refer to FIG. 19). Accordingly, since it is possible to prevent a step from being generated within the cell 307, it is possible to smoothly receive the spent fuel assembly within the cell 307. Further, a convex section 317 is formed in an end edge of the plate-like member 310. Further, as shown in FIG. 20, since the step is generated in the end edge of the plate-like member 310 by providing the convex section 317, a heat conducting plate 318 is extended between the adjacent steps. Accordingly, an outer peripheral surface of the basket 301 is formed. For a material of the plate-like member 310 and the heat conducting plate 318, there is employed a material obtained by adding the boron to the aluminum or the aluminum alloy corresponding to the same material as that of the first embodiment. In this case, the mounting of the heat conducting plate 318 is not limited to the method in which the convex section 317 is provided as shown in FIG. 20. For example, the structure may be made such that the heat conducting plate 318 is brought into contact with all the end edge of the plate-like member 310 so as to be fixed according to a spot welding or the like.

Figure 21:
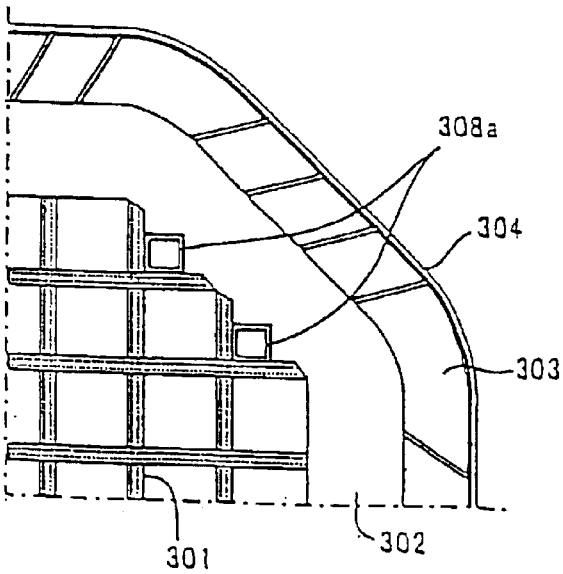
FIG. 21 is a modified embodiment of a dummy pipe.

In the outer shape of the basket 301, four surfaces 301*a* thereof are flush by the heat conducting surface 318, and the other four surfaces 301*b* are formed in a square cross sectional shape. An inner shape of the cavity 306 becomes flush in such a manner as to be in a substantially close attached state with the flush portion (301*a*) of the basket 301, and a portion corresponding to the square cross sectional portion (301*b*) of the basket 301 becomes substantially a shape corresponding to the shape, however, leaves a space S at a corner section. Next, in order to charge the space S, a dummy pipe 308 having a triangular cross sectional shape is inserted. Due to the dummy pipe 308, it is possible to reduce a weight of the barrel main body 302 and uniformize the thickness of the barrel main body 302. Further, it is possible to restrict a play of the basket 301 so as to securely fix. In this case, in place of the dummy pipe 308 having the triangular cross sectional shape, a dummy pipe 308*a* having a quadrangular cross sectional shape as shown in FIG. 21 can be used. In this case, the inner shape of the cavity 306 becomes the square cross sectional shape corresponding to the dummy pipe 308*a*.

A trunnion 309 is directly mounted to the barrel main body 302. At this time, it is preferable that a mounting position of the trunnion 309 is provided in the portion having the square cross sectional shape in the barrel main body 302. In the portion having the square cross sectional shape 302*b*, since a little surplus exists in the thickness of the barrel main body 302 rather than the flush section 302*a*, an influence is a little in view of the γ ray shielding even when working a trunnion seat. Further, a resin 309*a* is charged within the trunnion 309, however, it is possible to prevent the neutron from transmitting from the resin non-charged section 309*b* in the trunnion at some degree by charging the resin within the dummy pipe 308 provided in the space S.

As mentioned above, according to the cask 300, since the cavity 306 is formed so as to correspond to the outer shape of the box-of-cake shaped basket 301, the efficient of heat conduction from the basket 301 to the barrel main body 302 is improved. In particular, the decay heat is effectively transmitted to the barrel main body 302 via the heat conducting plate 318 provided on the outer peripheral surface of the basket, and a part in the portion having the square cross sectional shape 301*b* of the basket 301 is in surface contact with the barrel main body 302 so as to securely hold the basket 301 and improve the efficiency of the heat conduction. Further, since it is possible to resist against the deformation of the basket 301 by inserting the dummy pipe 308 to the space S, it is possible to more hold. Further, the efficiency of the heat conduction is further improved. In this case, in the structure mentioned above, it goes without saying that the efficiency of the heat conduction can be improved at some degree even when omitting the heat conducting plate 318.

Figure 22:
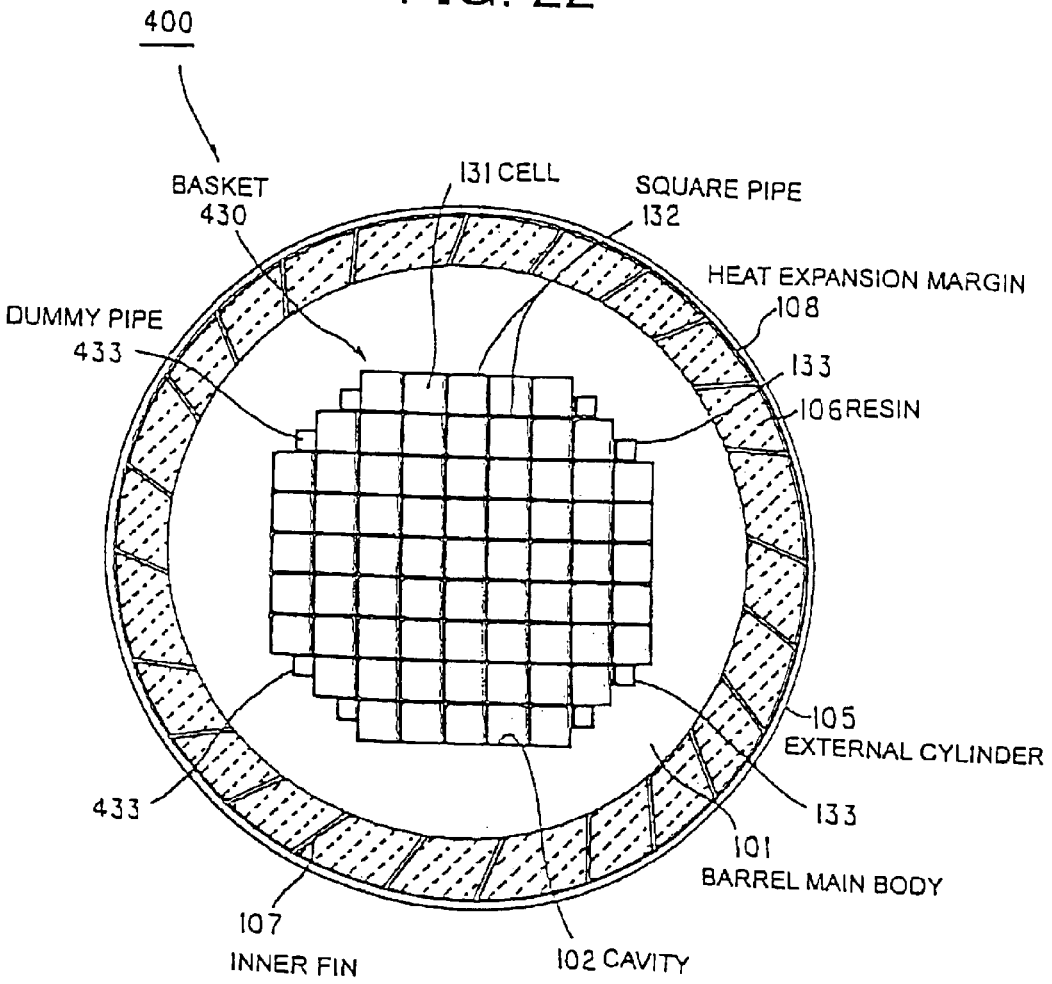
FIG. 22 is a cross sectional view in a diametrical direction of a cask according to a fourth embodiment of the present invention.

FIG. 22 is a cross sectional view in a diametrical direction of a cask according to a fourth embodiment of the invention. A cask 400 according to the fourth embodiment corresponds to a structure in which the box-of-cake shaped basket of the cask shown in the first embodiment mentioned above is changed to a square pipe shaped basket 430. Since the other structures are the same as those of the cask 100 according to the first embodiment, a description thereof will be omitted and the same reference numerals are attached to the same constituting elements. The basket 430 is constituted by sixty nine square pipes 132 constituting the cell 131 which receives the spent fuel assembly. For the square pipe 132, in the same manner as that mentioned above, there is employed the aluminum composite material obtained by adding the B or the B chemical compound powders having the neutron absorbing performance to the Al or the Al alloy powders. Further, for the neutron absorbing material, it is possible to use the cadmium in addition to the boron. The manufacturing method of the square pipe 132 is executed according to the extruding method shown in the first embodiment.

The square pipe 132 mentioned above is, for example, formed in a quadrangular shape in which one line of the cross section is 162 mm and an inner side is 151 mm. A tolerance of size sets a minus tolerance to 0 in connection with a required standard. Further, while an R of an inner angle is 5 mm, an R of an outer angle is 0.5 mm so as to be formed in a sharp edge. When the R in the edge section is large, when a stress is applied to the basket 430, a stress concentration is generated in a particular section (near the edge) of the square pipe 132, whereby it may cause a breakage. Accordingly, since the stress is straight forwardly transmitted to the adjacent angular pipes 132 by forming the square pipe 132 in a sharp edge, it is possible to avoid a stress concentration against the particular section of the square pipe 132. In this case, as another manufacturing method of the square pipe 132, there is a technique which has been already filed by the applicant of the present application on May 27, 1999 ("Basket and Cask") it is possible to refer to the technique.

Figure 23:
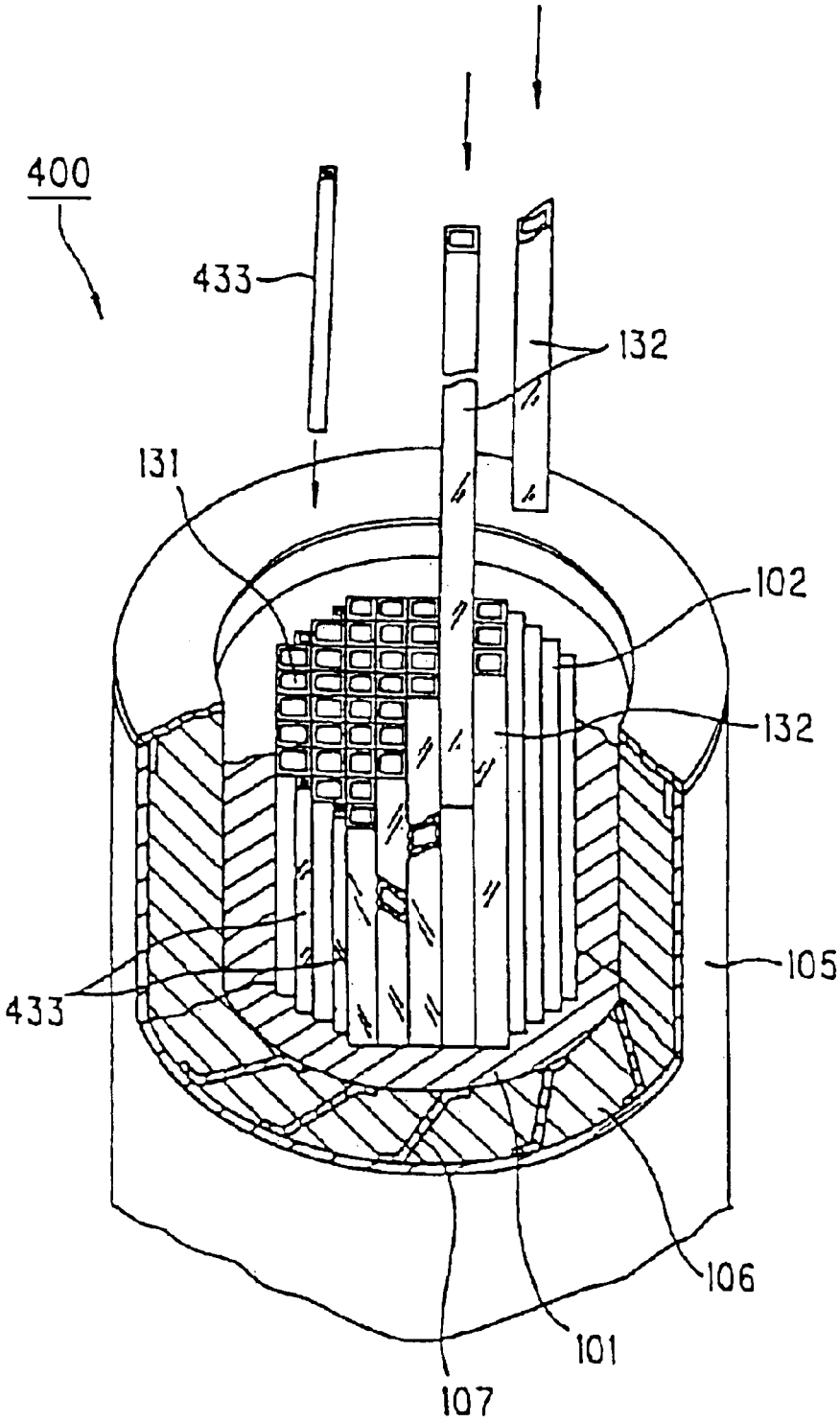
FIG. 23 is a perspective view which shows an inserting method of a square pipe shown in FIG. 22.

FIG. 23 is a perspective view which shows an inserting method of the square pipe. The square pipes 132 manufactured according to the steps mentioned above are sequentially inserted along the worked shape within the cavity 102. In this case, since a bending and a torsion are generated in the square pipe 132 and the minus tolerance of size is 0, it is hard to insert the square pipes 132 due to an accumulation of the tolerance and an influence of the bending when the square pipe 132 is going to be properly inserted, and if the square pipe is forcibly inserted, an excessive stress is applied to the square pipe 132. Accordingly, all or a part of the manufactured square pipes 132 are previously measured in view of the bending and the torsion by a laser measuring device or the like, and an optimum inserting position is determined on the basis of the measured data by using a computer. According to the structure mentioned above, it is possible to easily insert the square pipes 132 within the cavity 102, and it is possible to uniformize the stress applied to the respective square pipes 132.

Further, as shown in FIGS. 22 and 23, dummy pipes 433 are respectively inserted to both sides of square pipe lines having five or seven cells among the cavities 102. The dummy pipes 433 also employ the aluminum alloy containing the boron and are manufactured according to the same steps mentioned above. Further, covers are provided in both ends of the dummy pipes 433 (refer to FIG. 6A). The covers may be provided in the dummy pipes 433, or the cask 400 can be made light by sealing an inner section. Further, the structure may be made such that the neutron shielding material such as the helium, the resin or the like is charged in the inner sections of the dummy pipes 433.

As mentioned above, according to the cask of one aspect of the present invention, since the inner section of the cavity of the barren main body which has the neutron shielding body in the outer periphery and shields the γ rays is formed in the shape corresponding to the outer shape of the basket having the square cross sectional shape and constructed by alternately piling up a plurality of plate-like members, there is generated the section in which the basket is in surface contact with the inner surface of the cavity and the space between the basket and the cavity is lost or small. Accordingly, the efficiency of heat conduction can be improved and it is possible to increase the receiving number of the spent fuel assemblies. Further, it is possible to make the structure compact or light.

Further, according to the cask of another aspect of the present invention, since the inner section of the cavity of the barren main body which has the neutron shielding body in the outer periphery and shields the γ rays is formed in the shape corresponding to the outer shape of the integrally cast basket having the square cross sectional shape, the basket is in surface contact with the inner surface of the cavity and the space between the basket and the cavity is lost or small. Accordingly, the efficiency of heat conduction can be improved and it is possible to increase the receiving number of the spent fuel assemblies. Further, it is possible to make the structure compact or light.

Moreover, in the cask according to the above-mentioned aspects, a part within the cavity is formed in the shape corresponding to the outer shape of the basket. Therefore, although this cask becomes inferior to the cask according to the above-mentioned aspects, it is possible to improve the efficiency of heat conduction and it is possible to increase the receiving number of the spent fuel assemblies. Further, it is possible to make the structure compact or light.

Furthermore, in the cask according to the above-mentioned aspects, the dummy pipe is further provided, a portion having a surplus thickness of the barrel main body within the cavity is formed in the shape corresponding to the outer shape of the dummy pipe, and the dummy pipe is inserted within the cavity together with the basket in a state of being in contact with the plate-like member. Accordingly, it is possible to intend to make the cask further light. Further, it is possible to improve the efficiency of heat conduction.

Moreover, in the cask according to the above-mentioned aspects, both ends of the dummy pipe are closed. Therefore, it is possible to make the cask light.

In addition, in the cask according to the above-mentioned aspects, the heat conducting medium such as the helium gas or the like is sealed within the dummy pipe having both ends closed. Therefore, it is possible to make the cask light and improve the efficiency of heat conduction.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A cask comprising:

a basket including a plurality of rectangular plate members having a neutron absorbency and alternately piled up so as to continuously extend vertically, the plurality of rectangular plate members each having a plurality of cutting sections for mutually engaging the plurality of rectangular plate members, the rectangular plate members forming a plurality of cells each configured to hold a spent fuel assembly, the basket having a cross section having a plurality of stepped corners;

a barrel main body having a unitary construction which shields γ rays and has an inner cavity having a shape corresponding to an outer shape of the basket such that the inner cavity of the barrel main body makes direct contact with the outer shape of the basket along an entire vertical length of the inner cavity of the barrel main body; and a neutron shielding body provided in an outer periphery of the barrel main body.

2. A cask comprising:

a basket including a plurality of rectangular plate members having a neutron absorbency and alternately piled up so as to continuously extend vertically, the plurality of rectangular plate members each having a plurality of cutting sections for mutually engaging the plurality of rectangular plate members, the rectangular plate members forming a plurality of cells each configured to hold a spent fuel assembly, the basket having a cross section having a plurality of stepped corners;

a barrel main body having a unitary construction which shields γ rays and has an inner cavity having a shape corresponding to an outer share of the basket such that the inner cavity of the barrel main body makes direct contact with the outer shape of the basket alone an entire vertical length of the inner cavity of the barrel main body;

a plurality of dummy pipes provided along and making direct contact with an outer surface portion of the each of stepped corners of the basket, wherein a cavity cross section of the inner cavity corresponds with a cross section of an outer shape formed by the plurality of dummy pipes and the basket in contact with each other, and the plurality of dummy pipes are inserted within the inner cavity together with the basket; and a neutron shielding body provided in an outer periphery of the barrel main body.

3. The cask according to claim 2, wherein both ends of each of the plurality of dummy pipe are closed.

4. The cask according to claim 3, wherein the plurality of dummy pipes each includes a heat conduction medium therein.

5. The cask according to claim 4, wherein the heat conduction medium in the plurality of dummy pipes comprises a helium gas.

6. The cask according to claim 2, wherein the plurality of dummy pipes comprise an aluminum alloy containing boron.

7. A cask comprising:

a basket having a cross section having a plurality of stepped corners; and a barrel main body having a unitary construction and a cavity having a shape corresponding to an outer shape of the basket such that the cavity of the barrel main body makes direct contact with the outer shape of the basket along an entire vertical length of the inner cavity of the barrel main body.

* * * * *